US006184844B1

(12) United States Patent
Filipovic et al.

(10) Patent No.: US 6,184,844 B1
(45) **Date of Patent: *Feb. 6, 2001**

(54) DUAL-BAND HELICAL ANTENNA

(75) Inventors: Daniel Filipovic; Ali Tassoudji, both of San Diego; Stephen B. Tidwell, Carlsbad, all of CA (US)

(73) Assignee: Qualcomm Incorporated, San Diego, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/826,289

(22) Filed: Mar. 27, 1997

(51) Int. Cl.[7] ..... H01Q 1/36; H01Q 11/08

(52) U.S. Cl. ..... 343/895; 343/853

(58) Field of Search ..... 343/895, 853, 343/700 MS, 702; H01Q 1/36, 11/08

(56) References Cited

U.S. PATENT DOCUMENTS

| | | | | |
|---|---|---|---|---|
| 3,369,243 | | 2/1968 | Greiser | 343/792.5 |
| 4,008,479 | | 2/1977 | Smith | 343/895 |
| 4,148,030 | | 4/1979 | Foldes | 343/895 |
| 4,349,824 | * | 9/1982 | Harris | 343/700 MS |
| 4,400,702 | | 8/1983 | Tanaka | 343/790 |
| 4,658,262 | * | 4/1987 | DuHamel | 343/895 |
| 4,725,845 | | 2/1988 | Phillips | 343/702 |
| 5,134,422 | | 7/1992 | Auriol | 343/895 |
| 5,198,831 | | 3/1993 | Burrell et al. | 343/895 |
| 5,255,005 | | 10/1993 | Terret et al. | 343/895 |
| 5,298,910 | | 3/1994 | Takei et al. | 343/895 |
| 5,346,300 | | 9/1994 | Yamamoto et al. | 434/895 |
| 5,349,365 | | 9/1994 | Ow et al. | 343/895 |
| 5,359,340 | | 10/1994 | Yokota | 343/792 |
| 5,450,093 | | 9/1995 | Kim | 343/895 |
| 5,479,180 | | 12/1995 | Lenzing et al. | 343/729 |
| 5,485,170 | | 1/1996 | Mccarrick | 343/895 |
| 5,541,617 | | 7/1996 | Connolly et al. | 343/895 |
| 5,559,524 | | 9/1996 | Takei et al. | 343/895 |
| 5,581,268 | | 12/1996 | Hirshfield | 343/895 |
| 5,600,341 | * | 2/1997 | Thill et al. | 343/895 |
| 5,612,707 | | 3/1997 | Vaughan et al. | 343/895 |
| 5,828,348 | * | 10/1998 | Tassoudji et al. | 343/895 |
| 5,986,620 | * | 11/1999 | Filipovic | 343/895 |

FOREIGN PATENT DOCUMENTS

| | | | |
|---|---|---|---|
| 0320404 | 6/1989 | (EP) | H01Q/11/08 |
| 0715369 | 6/1996 | (EP) | H01Q/11/08 |
| 0757406 | 2/1997 | (EP) | H01Q/11/08 |
| 0805513 | 11/1997 | (EP) | H01Q/11/08 |
| 03236612 | 10/1991 | (JP) | H01Q/9/27 |
| 9711507 | 3/1997 | (WO) | H01Q/11/08 |
| 9741695 | 11/1997 | (WO) . | |
| 9805087 | 2/1998 | (WO) | H01Q/1/36 |

OTHER PUBLICATIONS

Jalil Rashed et al., "A New Class of Resonant Antennas", *IEEE Transactions on Antennas and Propagation*, vol. 39, No. 9, Sep. 9, 1991, pp. 1428–1430.

Kraus, John D. "Antennas", Second Edition, McGraw–Hill, Inc., New York, 1988 Chapter 7 and Section 11–9.

* cited by examiner

*Primary Examiner*—Don Wong
*Assistant Examiner*—Hoang Nguyen
(74) *Attorney, Agent, or Firm*—Phillip R. Wadsworth; Gregory D. Ogrod

(57) ABSTRACT

A dual-band helical antenna provides operation in two frequency bands. The dual-band helical antenna includes two single-band antennas, each having a feed network, a ground plane opposite the feed network, and a set of one or more radiators extending from feed network. According to one aspect of the invention, a tab extends from the feed network of one of the antennas which provides a feed for that antenna. The tab also provides a path for current to flow from the radiators of the second antenna along the axis of the second antenna to thereby increase the energy radiated in the directions perpendicular to the axis. According to another feature of the invention, the ground plane of one antenna is used as a shorting ring for the other antenna.

25 Claims, 22 Drawing Sheets

DUAL-BAND HELICAL ANTENNA

BACKGROUND OF THE INVENTION

I. Field of the Invention

The present invention relates to helical antennas. More particularly, the present invention relates to a novel and improved dual-band helical antenna having coupled radiator segments.

II. Description of the Related Art

Contemporary personal communication devices are enjoying widespread use in numerous mobile and portable applications. With traditional mobile applications, the desire to minimize the size of the communication device, such as a mobile telephone for example, led to a moderate level of downsizing. However, as the portable, hand-held applications increase in popularity, the demand for smaller and smaller devices increases dramatically. Recent developments in processor technology, battery technology and communications technology have enabled the size and weight of the portable device to be reduced drastically over the past several years.

One area in which reductions in size are desired is the device's antenna. The size and weight of the antenna play an important role in downsizing the communication device. The overall size of the antenna can impact the size of the device's body. Smaller diameter and shorter length antennas can allow smaller overall device sizes as well as smaller body sizes.

Size of the device is not the only factor that needs to be considered in designing antennas for portable applications. Another factor to be considered in designing antennas is attenuation and/or blockage effects resulting from the proximity of the user's head to the antenna during normal operations. Yet another factor is the characteristics of the communication link, such as, for example, desired radiation patterns and operating frequencies.

An antenna that finds widespread usage in satellite communication systems is the helical antenna. One reason for the helical antenna's popularity in satellite communication systems is its ability to produce and receive circularly-polarized radiation employed in such systems. Additionally, because the helical antenna is capable of producing a radiation pattern that is nearly hemispherical, the helical antenna is particularly well suited to applications in mobile satellite communication systems and in satellite navigational systems.

Conventional helical antennas are made by twisting the radiators of the antenna into a helical structure. A common helical antenna is the quadrifilar helical antenna which utilizes four radiators spaced equally around a core and excited in phase quadrature (i.e., the radiators are excited by signals that differ in phase by one quarter of a period or 90°). The length of the radiators is typically an integer multiple of a quarter wavelength of the operating frequency of the communication device. The radiation patterns are typically adjusted by varying the pitch of the radiator, the length of the radiator (in integer multiples of a quarter-wavelength), and the diameter of the core.

Conventional helical antennas can be made using wire or strip technology. With strip technology, the radiators of the antenna are etched or deposited onto a thin, flexible substrate. The radiators are positioned such that they are parallel to each other, but at an obtuse angle to the sides (or edges) of the substrate. The substrate is then formed, or rolled, into a cylindrical, conical, or other appropriate shape causing the strip radiators to form a helix.

This conventional helical antenna, however, also has the characteristic that the radiator lengths are an integer multiple of one quarter wavelength of the desired resonant frequency, resulting in an overall antenna length that is longer than desired for some portable or mobile applications.

Additionally, in applications where transmit and receive communications occur at different frequencies, dual-band antennas are desirable. However, dual-band antennas are often available only in less than desirable configurations. For example, one way in which a dual band antenna can be made is to stack two single-band quadrifilar helix antennas end-to-end, so that they form a single cylinder. A disadvantage of this solution, however, is that such an antenna is longer than would otherwise be desired for portable, or hand-held applications.

Another technique for providing dual-band performance has been to utilize two separate single band antennas. However, for hand-held units, the two antennas would have to be located in close proximity to one another. Two single band antennas, placed in close proximity on a portable, or hand-held unit would cause coupling between the two antennas, leading to degraded performance as well as unwanted interference.

SUMMARY OF THE INVENTION

The present invention is a novel and improved dual-band helical antenna having two sets of one or more helically wound radiators. The radiators are wound, or wrapped, such that the antenna is in a cylindrical, conical, or other appropriate shape to optimize or otherwise obtain desired radiation patterns. According to the invention, one set of radiators is provided for operation at a first frequency and the second set is provided for operation at a second frequency which preferably is different from the first frequency. Each set of radiators has an associated feed network to provide the signals to drive the radiators. Thus, the dual-band antenna can be described as being comprised of two single-band antennas, each single-band antenna having a radiator portion and a feed portion.

To provide dual-band operation in an integrated antenna package, the two sets of radiators and their associated feed networks (i.e., the two single-band antennas) are stacked, or positioned end-to-end such that they are coaxially aligned with one another.

In one embodiment, the stacked antennas are positioned such that they have the same orientation. That is, their feed portions are oriented toward one end of the dual-band antenna and their radiator portions are oriented toward the other end. Consequently, the portions of the dual-band antenna, from one end of the antenna to the other are: a radiator portion of the first single-band antenna, a feed portion of the first single-band antenna, a radiator portion of the second single-band antenna, and a feed portion of the second single-band antenna.

In one embodiment, each radiator of at least one set of one or more radiators is comprised of two radiator segments. One radiator segment extends in a helical fashion from a first end of the radiator portion of the antenna toward the other end of the radiator portion. A second radiator segment extends in a helical fashion from a central area of the dual-band antenna (i.e., from the other end of the radiator portion of the second single-band antenna) toward the first end of the radiator portion.

In this embodiment, each segment in the set is physically separate from but electromagnetically coupled to the adjacent segment(s) in the set. The length of the segments in the set is chosen such that the set (i.e., the radiator(s)) resonates at a particular frequency. Because the segments in a set are physically separate from but electromagnetically coupled to one another, the length at which the radiator resonates for a given frequency can be made shorter than that of a conventional helical antenna radiator.

As a result of this structure, electromagnetic energy from the first segment of a radiator in the first set is coupled into the second segment of that radiator. The effective electrical length of these combined segments causes the radiator in the first set of one or more radiators to resonate at a given frequency.

An advantage of this coupled multi-segment embodiment is that it can be easily tuned to a given frequency by adjusting or trimming the length of the radiator segments. Because the radiators are not a single contiguous length, but instead are made up of a set of two or more segments, the length of the segments is easily modified after the antenna has been made to properly tune the frequency of the antenna. Additionally, the overall radiation pattern of the antenna is essentially unchanged by the tuning because the segments can be trimmed without changing the location of the segments.

In another embodiment, the components of the dual-band antenna are disposed on the substrate such that the ground plane for the feed portion of the first single-band antenna is used as a shorting ring around the end of the radiators of the second single band antenna. As a result of this configuration, there is not the need for an additional structure to provide the shorting function which allows the second antenna to resonate at even integer multiples of one-half a wavelength of the resonant frequency.

In yet another embodiment, the feed network used to provide the phased signals to the radiators is modified to conserve space. Specifically, portions of the feed network are disposed on the radiator portion of the antenna, thereby covering less area on the feed portion. As a result, the overall size of the antenna can be reduced, and the amount of loss in the feed is reduced.

In still another embodiment of the antenna, a tab is provided to feed the signal to the first single-band antenna. The tab extends from the feed portion of the first single-band antenna. When the antenna is formed into a cylinder or other appropriate shape, the tab is aligned with the axis of the antenna. More specifically, in a preferred embodiment, the tab extends radially inward to provide a centrally located feed structure. Thus, the tab and the feed line do not interfere with the signal patterns of the second single-band antenna.

An advantage of the invention is that its directional characteristics can be adjusted to maximize signal strength in one direction along the axis of the antenna. Thus for certain applications, such as satellite communications for example, the directional characteristics of the antenna can be optimized to maximize signal strength in the upward direction, away from the ground.

Another advantage of the invention is that current flowing from the radiators of the second antenna into the tab of the first antenna tends to widen the radiation pattern of the first antenna. This tends to make the antenna more suitable for certain satellite communication applications where low-earth orbiting satellites are used in the communication.

BRIEF DESCRIPTION OF THE DRAWINGS

The features, objects, and advantages of the present invention will become more apparent from the detailed description set forth below when taken in conjunction with the drawings in which like reference characters identify correspondingly throughout. Additionally, the left-most digit (s) of a reference number identifies the drawing in which the reference first appears.

DETAILED DESCRIPTION OF THE PREFERRED EMBODIMENTS

I. Overview and Discussion of the Invention

The present invention is directed toward a dual-band helical antenna capable of resonating at two different operating frequencies. According to the invention, two helical antennas are stacked end to end, with one antenna resonating at a first frequency and the other antenna resonating at a second frequency. Each antenna has a radiator portion comprised of one or more helically-wound radiators. Each antenna also has a feed portion comprised of a feed network and a ground plane. A tab is provided to feed a signal to the first single-band antenna. The tab extends from the feed portion of the first single-band antenna. When the antenna is formed into a cylinder or other appropriate shape, the tab is aligned with the axis of the antenna. More specifically, in a preferred embodiment, the tab extends radially inward to provide a centrally located feed structure. The manner in which this is accomplished is described in detail below according to several embodiments.

II. Example Environment

In a broad sense, the invention can be implemented in any system for which helical antenna technology can be utilized. One example of such an environment is a communication system in which users having fixed, mobile and/or portable telephones communicate with other parties through a satellite communication link. In this example environment, the telephone is required to have an antenna tuned to the frequency satellite communication link.

The present invention is described in terms of this example environment. Description in these terms is provided for convenience only. It is not intended that the invention be limited to application in this example environment. In fact, after reading the following description, it will become apparent to a person skilled in the relevant art how to implement the invention in alternative environments.

III. Conventional Helical Antennas

Figure 1A:
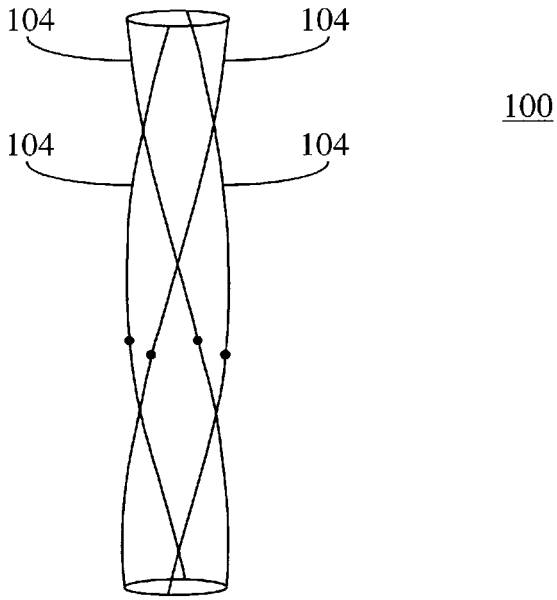
FIG. 1A is a diagram illustrating a conventional wire quadrifilar helical antenna.
Figure 1B:
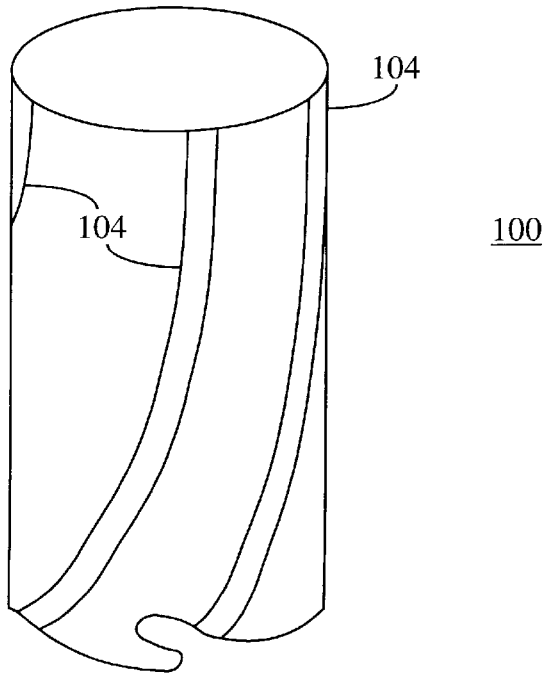
FIG. 1B is a diagram illustrating a conventional strip quadrifilar helical antenna.

Before describing the invention in detail, it is useful to describe the radiator portions of some conventional helical antennas. Specifically, this section of the document describes radiator portions of some conventional quadrifilar helical antennas. FIGS. 1A and 1B are diagrams illustrating a radiator portion 100 of a conventional quadrifilar helical antenna in wire form and in strip form, respectively. The radiator portion 100 illustrated in FIGS. 1A and 1B is that of a quadrifilar helical antenna, meaning it has four radiators 104A–104D operating in phase quadrature. As illustrated in FIGS. 1A and 1B, radiators 104A–104D are wound to provide circular polarization.

Figure 2A:
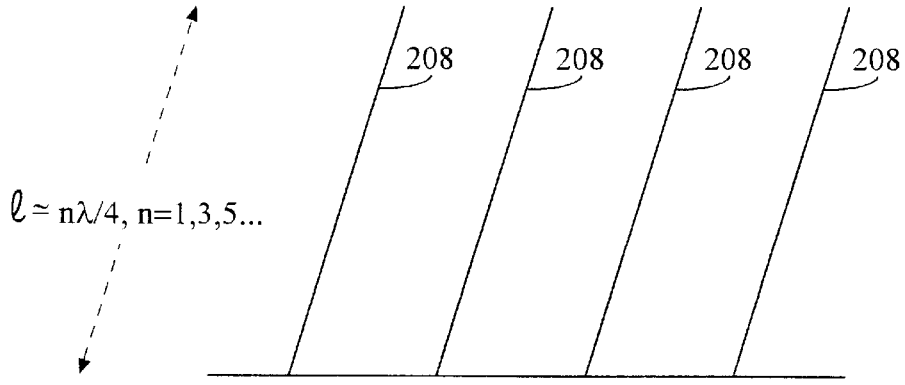
FIG. 2A is a diagram illustrating a planar representation of an open-circuited, or open terminated, quadrifilar helical antenna.
Figure 2B:
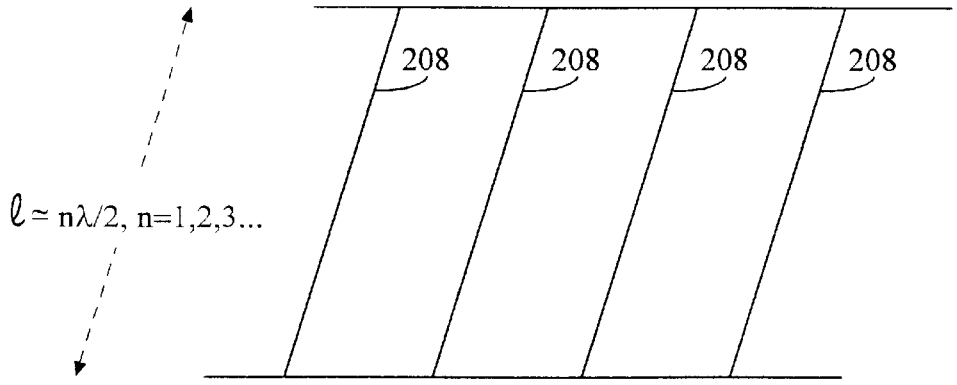
FIG. 2B is a diagram illustrating a planar representation of a short-circuited quadrifilar helical antenna.

FIGS. 2A and 2B are diagrams illustrating planar representations of a radiator portion of conventional quadrifilar helical antennas. In other words, FIGS. 2A and 2B illustrate the radiators as they would appear if the antenna cylinder were "unrolled" on a flat surface. FIG. 2A is a diagram illustrating a quadrifilar helical antenna which is open-circuited, or open terminated, at the far end. For such a configuration, the resonant length l of the radiators 208 is an odd integer multiple of a quarter-wavelength of the desired resonant frequency.

FIG. 2B is a diagram illustrating a quadrifilar helical antenna which is short-circuited, or electrically connected, at the far end. In this case the resonant length l of radiators 208 is an even integer multiple of a quarter wavelength of the desired resonant frequency. Note that in both cases, the stated resonant length l is approximate, because a small adjustment is usually needed to compensate for non-ideal short and open terminations.

Figure 3:
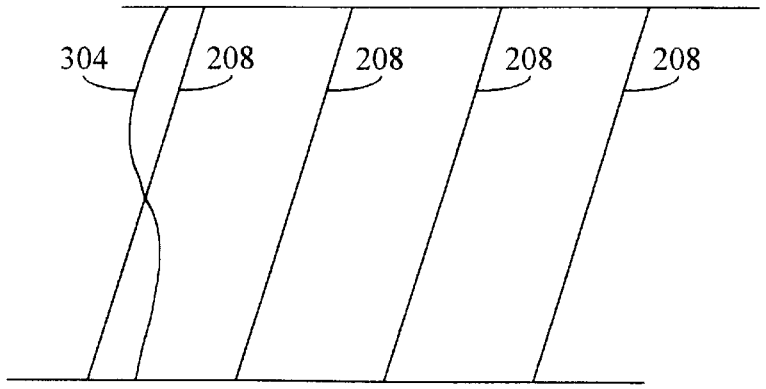
FIG. 3 is a diagram illustrating current distribution on a radiator of a short-circuited quadrifilar helical antenna.

FIG. 3 is a diagram illustrating a planar representation of a radiator portion of a quadrifilar helical antenna 300, which includes radiators 208 having a length $l=\lambda/2$, where $\lambda$ is the wavelength of the desired resonant frequency of the antenna. Curve 304 represents the relative magnitude of current for a signal on a radiator 208 that resonates at a frequency of $f=v/\lambda$, where v is the velocity of the signal in the medium.

Example implementations of a quadrifilar helical antenna implemented using printed circuit board techniques (a strip antenna) are described in more detail with reference to FIGS. 4–6. The strip quadrifilar helical antenna is comprised of strip radiators 104A–104D etched onto a dielectric substrate 406. The substrate is a thin flexible material that is rolled into a cylindrical, conical or other appropriate shape such that radiators 104A–104D are helically wound about a central axis of the cylinder.

Figures 4, 5:
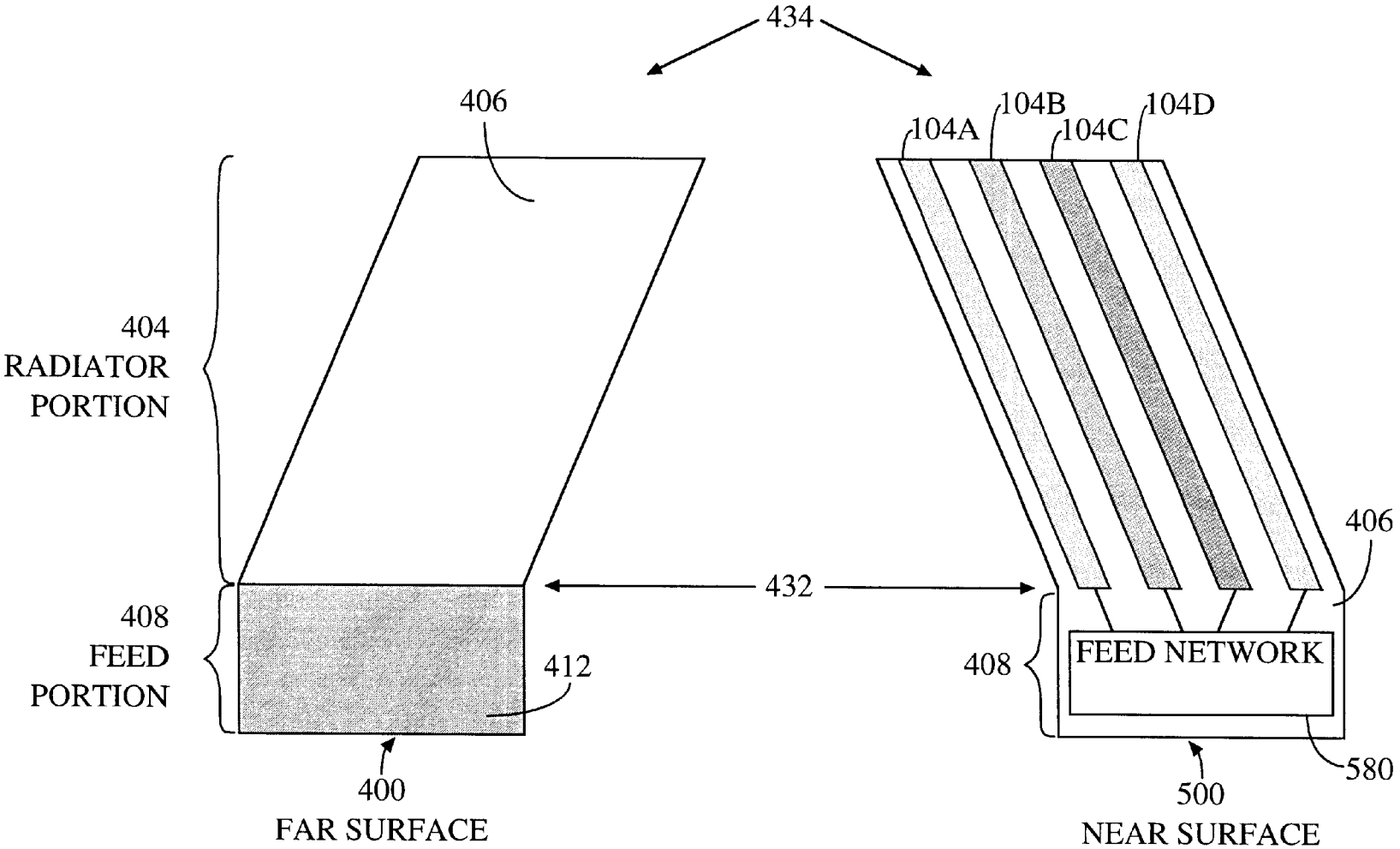
FIG. 4 is a diagram illustrating a far surface of an etched substrate of a strip helical antenna.
FIG. 5 is a diagram illustrating a near surface of an etched substrate of a strip helical antenna.
Figure 6:
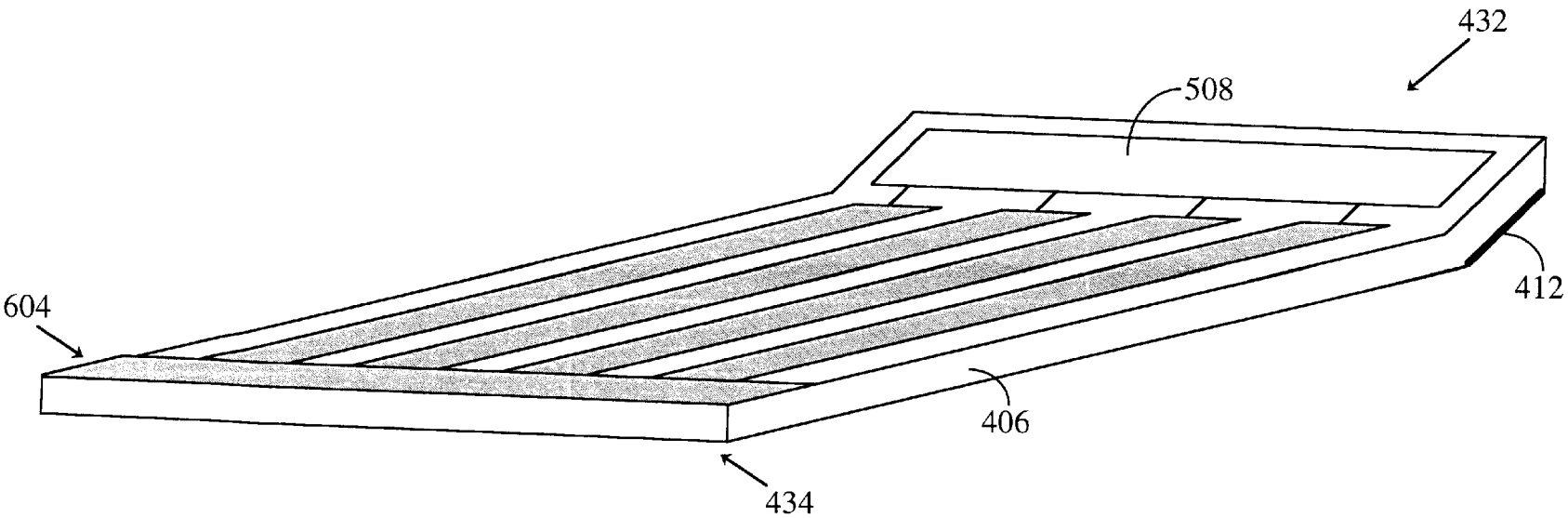
FIG. 6 is a diagram illustrating a perspective view of an etched substrate of a strip helical antenna.

FIGS. 4–6 illustrate the components used to fabricate a quadrifilar helical antenna 100. FIGS. 4 and 5 present a view of a far surface 400 and near surface 500 of substrate 406, respectively. The antenna 100 includes a radiator portion 404, and a feed portion 408.

In the embodiments described and illustrated herein, the antennas are described as being made by forming the substrate into a cylindrical shape with the near surface being on the outer surface of the formed cylinder. In alternative embodiments, the substrate is formed into the cylindrical shape with the far surface being on the outer surface of the cylinder.

In one embodiment, dielectric substrate 100 is a thin, flexible layer of polytetraflouroethalene (PTFE), a PTFE/glass composite, or other dielectric material. In one embodiment, substrate 406 is on the order of 0.005 in., or 0.13 mm thick, although other thicknesses can be chosen. Signal traces and ground traces are provided using copper. In alternative embodiments, other conducting materials can be chosen in place of copper depending on cost, environmental considerations and other factors.

In the embodiment illustrated in FIG. 5, feed network 508 is etched onto feed portion 408 to provide the quadrature phase signals (i.e., the 0°, 90°, 180° and 270° signals) that are provided to radiators 104A–104D. Feed portion 408 of far surface 400 provides a ground plane 412 for feed circuit 508. Signal traces for feed circuit 508 are etched onto near surface 500 of feed portion 408.

For purposes of discussion, radiator portion 404 has a first end 432 adjacent to feed portion 408 and a second end 434 (on the opposite end of radiator portion 404). Depending on the antenna embodiment implemented, radiators 104A–104D can be etched into far surface 400 of radiator portion 404. The length at which radiators 104A–104D extend from first end 432 toward second end 434 is approximately an integer multiple of a quarter wavelength of the desired resonant frequency.

In such an embodiment where radiators 104A–104D are an integer multiple of $\lambda/2$, radiators 104A–104D are electrically connected to each other (i.e., shorted, or short circuited) at second end 434. This connection can be made by a conductor across second end 434 which forms a ring 604 around the circumference of the antenna when the substrate is formed into a cylinder. FIG. 6 is a diagram illustrating a perspective view of an etched substrate of a strip helical antenna having a shorting ring 604 at second end 434.

One conventional quadrifilar helical antenna is described in U.S. Pat. No. 5,198,831 to Burrell et. al. (referred to as the '831 patent), which is incorporated herein by reference. The antenna described in the '831 patent is a printed circuit-board antenna having the antenna radiators etched or otherwise deposited on a dielectric substrate. The substrate is formed into a cylinder resulting in a helical configuration of the radiators.

Another conventional quadrifilar helical antenna is disclosed in U.S. Pat. No. 5,255,005 to Terret et al (referred to as the '005 patent) which is incorporated herein by reference. The antenna described in the '005 patent is a quadrifilar helical antenna formed by two bifilar helices positioned orthogonally and excited in phase quadrature. The disclosed antenna also has a second quadrifilar helix that is coaxial and electromagnetically coupled with the first helix to improve the passband of the antenna.

Yet another conventional quadrifilar helical antenna is disclosed in U.S. Pat. No. 5,349,365, to Ow et al (referred to as the '365 patent) which is incorporated herein by reference. The antenna described in the '365 patent is a quadrifilar helical antenna designed in wireform as described above with reference to FIG. 1A.

IV. Coupled Multi-Segment Helical Antenna

In order to reduce the length of radiator portion 100 of the antenna, one form of helical antenna utilizes coupled multi-segment radiators that allow for resonance at a given frequency at shorter lengths than would otherwise be needed for a helical antenna with an equivalent resonant length.

Figure 7A:
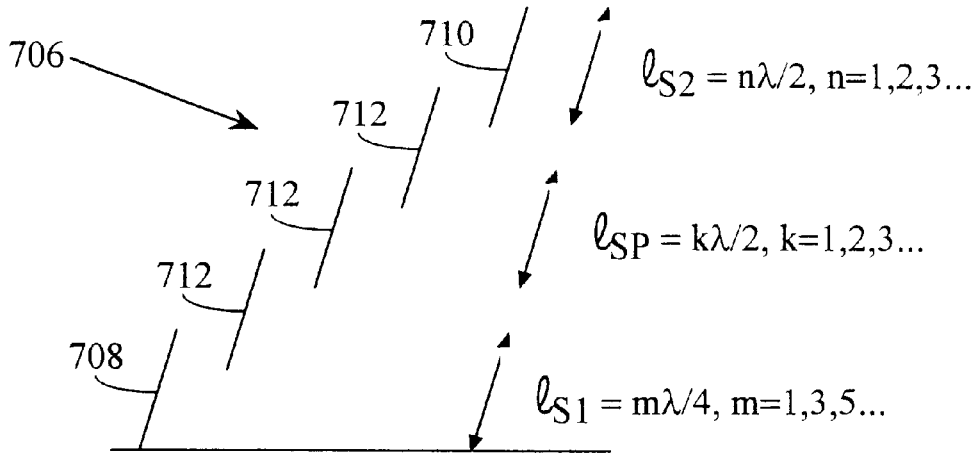
FIG. 7A is a diagram illustrating an open-circuit coupled multi-segment radiator having five coupled segments according to one embodiment of the invention.
Figure 7B:
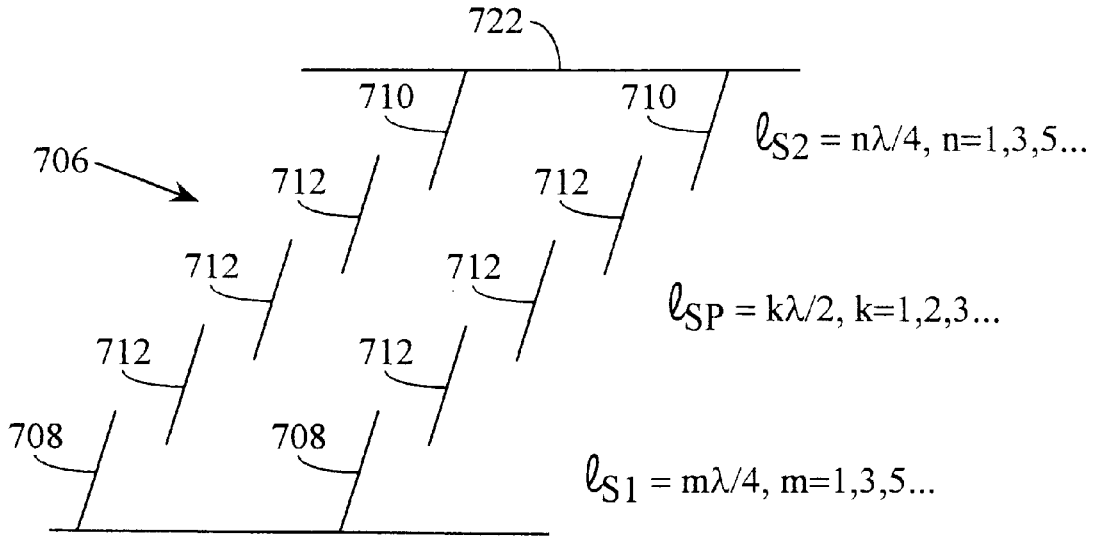
FIG. 7B is a diagram illustrating a pair of short-circuited coupled multi-segment radiators according to one embodiment of the invention.

FIGS. 7A and 7B are diagrams illustrating planar representations of example embodiments of coupled-segment helical antennas. FIG. 7A illustrates a coupled multi-segment radiator 706 terminated in an open-circuit according to one single-filar embodiment. An antenna terminated in an open-circuit such as this may be used in a single-filar, bifilar, quadrifilar, or other x-filar implementation.

The embodiment illustrated in FIG. 7A is comprised of a single radiator 706. Radiator 706 is comprised of a set of radiator segments. This set is comprised of two end segments 708, 710 and p intermediate segments 712, where p=0, 1, 2, 3 . . . (the case where p=3 is illustrated). Intermediate segments are optional (i.e., p can equal zero). End segments 708, 710 are physically separate from but electromagnetically coupled to one another. Intermediate segments 712 are positioned between end segments 708, 710 and provide electromagnetic coupling between end segments 708, 710.

In the open-terminated embodiment, the length $l_{s1}$ of segment 708 is an odd-integer multiple of one-quarter wavelength of the desired resonant frequency. The length $l_{s2}$ of segment 710 is an integer multiple of one-half the wavelength of the desired resonant frequency. The length $l_{sp}$ of each of the p intermediate segments 712 is an integer multiple of one-half the wavelength of the desired resonant frequency. In the illustrated embodiment, there are three intermediate segments 712 (i.e., p=3).

FIG. 7B illustrates radiators 706 of the helical antenna when terminated in a short circuit 722. This short-circuited implementation is not suitable for a single-filar antenna, but can be used for bifilar, quadrifilar or other x-filar antennas. As with the open-circuited embodiment, radiators 706 are comprised of a set of radiator segments. This set is comprised of two end segments 708, 710 and p intermediate segments 712, where p=0, 1, 2, 3 . . . (the case where p=3 is illustrated). Intermediate segments are optional (i.e., p can equal zero). End segments 708, 710 are physically separate from but electromagnetically coupled to one another. Intermediate segments 712 are positioned between end segments 708, 710 and provide electromagnetic coupling between end segments 708, 710.

In the short-circuited embodiment, the length $l_{s1}$ of segment 708 is an odd-integer multiple of one-quarter wavelength of the desired resonant frequency. The length $l_{s2}$ of segment 710 is an odd-integer multiple of one-quarter wavelength of the desired resonant frequency. The length $l_{sp}$ of each of the p intermediate segments 712 is an integer multiple of one-half the wavelength of the desired resonant frequency. In the illustrated embodiment, there are three intermediate segments 712 (i.e., p=3).

Figure 8A:
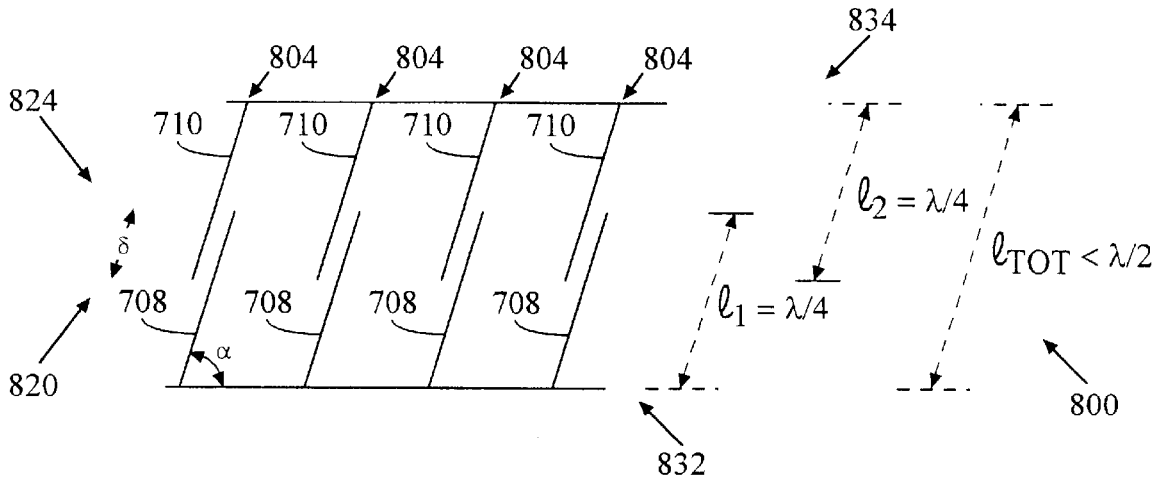
FIG. 8A is a diagram illustrating a planar representation of a short-circuited coupled multi-segment quadrifilar helical antenna according to one embodiment of the invention.
Figure 8B:
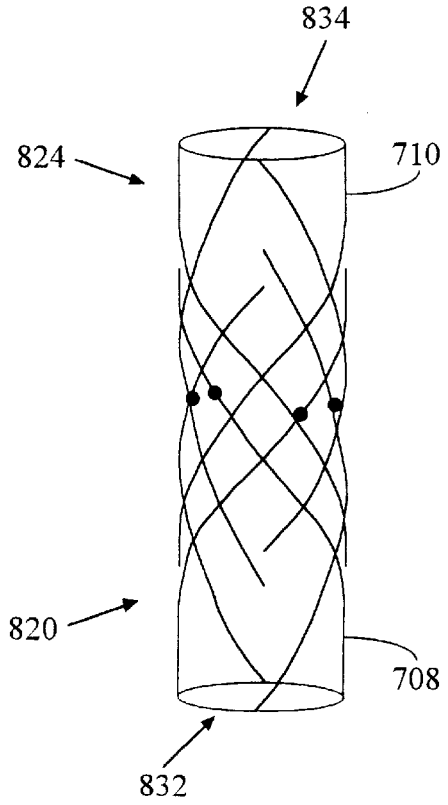
FIG. 8B is a diagram illustrating a coupled multi-segment quadrifilar helical antenna formed into a cylindrical shape according to one embodiment of the invention.

FIGS. 8A and 8B are diagrams illustrating a coupled multi-segment quadrifilar helical antenna radiator portion 800 according to one embodiment of the invention. FIGS. 8A and 8B illustrate one example implementation of the antenna illustrated in FIG. 7B, where p=zero (i.e., there are no intermediate segments 712) and the lengths of segments 708, 710 are one-quarter wavelength.

The radiator portion 800 illustrated in FIG. 8A is a planar representation of a quadrifilar helical antenna, having four coupled radiators 804. Each coupled radiator 804 in the coupled antenna is actually comprised of two radiator segments 708, 710 positioned in close proximity with one another such that the energy in radiator segment 708 is coupled to the other radiator segment 710.

More specifically, according to one embodiment, radiator portion 800 can be described in terms of having two sections 820, 824. Section 820 is comprised of a plurality of radiator segments 708 extending from a first end 832 of the radiator portion 800 toward the second end 834 of radiator portion 800. Section 824 is comprised of a second plurality of radiator segments 710 extending from second end 834 of the radiator portion 800 toward first end 832. Toward the center area of radiator portion 800, a part of each segment 708 is in close proximity to an adjacent segment 710 such that energy from one segment is coupled into the adjacent segment in the area of proximity. This is referred to in this document as overlap.

In a preferred embodiment, each segment 708, 710 is of a length of approximately $l_1=l_2=\lambda/4$. The overall length of a single radiator comprising two segments 708, 710 is defined as $l_{tot}$. The amount one segment 708 overlaps another segment 710 is defined as $\delta=l_1+l_2-l_{tot}$.

For a resonant frequency $f=v/\lambda$ the overall length of a radiator $l_{tot}$ is less than the half-wavelength length of $\lambda/2$. In other words, as a result of coupling, a radiator, comprising a pair of coupled segments 708, 710, resonates at frequency $f=v/\lambda$ even though the overall length of that radiator is less than a length of $\lambda/2$. Therefore, the radiator portion 800 of a ½ wavelength coupled multi-segment quadrifilar helical antenna is shorter than the radiator portion of conventional half-wavelength quadrifilar helical antenna 800 for a given frequency $f$.

For a clearer illustration of the reduction in size gained by using the coupled configuration, compare the radiator portions 800 illustrated in FIG. 8 with those illustrated in FIG. 3. For a given frequency $f=v/\lambda$, the length l of radiator portion 300 of the conventional antenna is $\lambda/2$, while the length $l_{tot}$ of radiator portion 800 of the coupled radiator segment antenna is less than $\lambda/2$.

As stated above, in one embodiment, segments 708, 710 are of a length $l_1=l_2=\lambda/4$. The length of each segment can be varied such that $l_1$ is not necessarily equal to $l_2$, and such that they are not equal to $\lambda/4$. The actual resonant frequency of each radiator is a function of the length of radiator segments 708, 710 the separation distance s between radiator segments 708, 710 and the amount which segments 708, 710 overlap each other.

Note that changing the length of one segment 708 with respect to the other segment 710 can be used to adjust the bandwidth of the antenna. For example, lengthening $l_1$ such that it is slightly greater than $\lambda/4$ and shortening $l_2$ such that it is slightly shorter than $\lambda/4$ can increase the bandwidth of the antenna.

FIG. 8B illustrates the actual helical configuration of a coupled multi-segment quadrifilar helical antenna according to one embodiment of the invention. This illustrates how each radiator is comprised of two segments 708, 710 in one embodiment. Segment 708 extends in a helical fashion from first end 832 of the radiator portion toward second end 834 of the radiator portion. Segment 710 extends in a helical fashion from second end 834 of the radiator portion toward first end 832 of the radiator portion. FIG. 8B further illustrates that a portion of segments 708, 710 overlap such that they are electromagnetically coupled to one another.

Figure 9A:
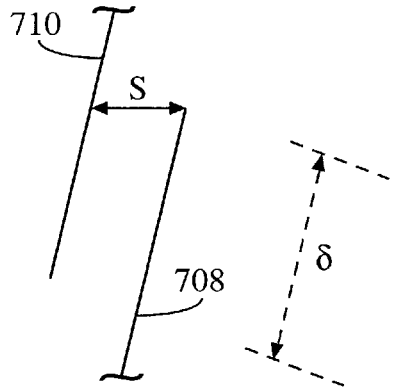
FIG. 9A is a diagram illustrating overlap 6 and spacing s of radiator segments according to one embodiment of the invention.

FIG. 9A is a diagram illustrating the separation s and overlap 6 between radiator segments 708, 710. Separation s is chosen such that a sufficient amount of energy is coupled between the radiator segments 708, 710 to allow them to function as a single radiator of an effective electrical length of approximately $\lambda/2$ and integer multiples thereof.

Spacing of radiator segments 708, 710 closer than this optimum spacing results in greater coupling between segments 708, 710. As a result, for a given frequency $f$ the length of segments 708, 710 must increase to enable resonance at the same frequency $f$. This can be illustrated by the extreme case of segments 708, 710 being physically connected (i.e., s=0). In this extreme case, the total length of segments 708, 710 must equal $\lambda/2$ for the antenna to resonate. Note that in this extreme case, the antenna is no longer really 'coupled' according to the usage of the term in this specification, and the resulting configuration is actually that of a conventional helical antenna such as that illustrated in FIG. 3.

Similarly, increasing the amount of overlap $\delta$ of segments 708, 710 increases the coupling. Thus as overlap $\delta$ increases, the length of segments 708, 710 increases as well.

Figure 9B:
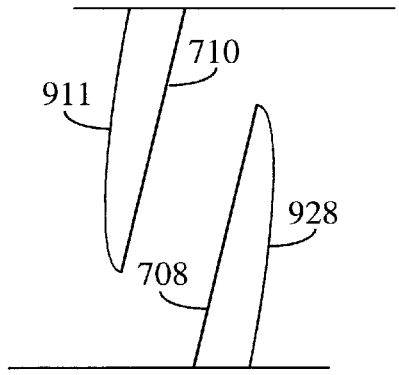
FIG. 9B is a diagram illustrating example current distributions on radiator segments of the coupled multi-segment helical antenna.

To qualitatively understand the optimum overlap and spacing for segments 708, 710, refer to FIG. 9B. FIG. 9B represents a magnitude of the current on each segment 708, 710. Current strength indicators 911, 928 illustrate that each segment ideally resonates at $\lambda/4$, with the maximum signal strength at the outer ends and the minimum at the inner ends.

To optimize antenna configurations for the coupled radiator segment antenna, the inventors utilized modeling software to determine correct segment length $l_1$, $l_2$, overlap $\delta$, and spacing s among other parameters. One such software package is the Antenna Optimizer (AO) software package. AO is based on a method of moments electromagnetic antenna-modeling algorithm. AO Antenna Optimizer version 6.35, copyright 1994, was written by and is available from Brian Beezley, of San Diego, Calif.

Note that there are certain advantages obtained by using a coupled configuration as described above with reference to FIGS. 8A and 8B. With both the conventional antenna and the coupled radiator segment antenna, current is concentrated at the ends of the radiators. Pursuant to array factor theory, this can be used to an advantage with the coupled radiator segment antenna in certain applications.

Figure 10A:
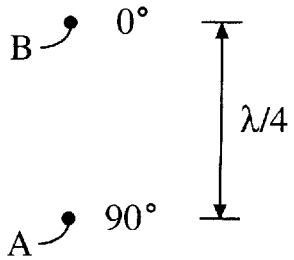
FIG. 10A is a diagram illustrating two point sources radiating signals differing in phase by 90°.
Figure 10B:
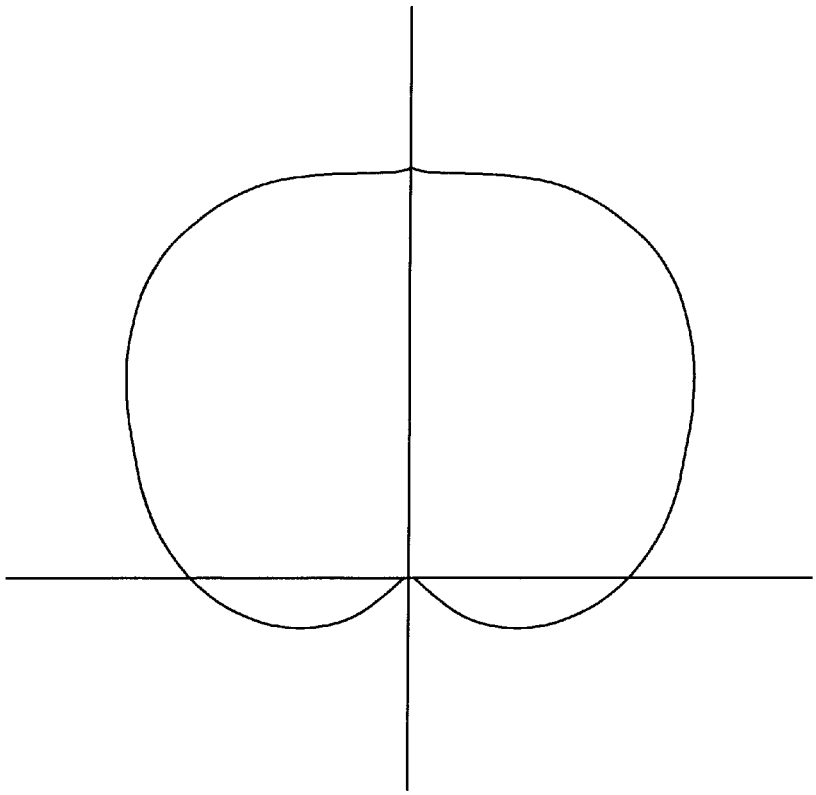
FIG. 10B is a diagram illustrating field patterns for the point sources illustrated in FIG. 10A.

To explain, FIG. 10A is a diagram illustrating two point sources, A, B, where source A is radiating a signal having a magnitude equal to that of the signal of source B but lagging in phase by 90° (the $e^{j\omega t}$ convention is assumed). Where sources A and B are separated by a distance of $\lambda/4$, the signals add in phase in the direction traveling from A to B and add out of phase in the direction from B to A. As a result, very little radiation is emitted in the direction from B to A. A typical representative field pattern shown in FIG. 10B illustrates this point.

Thus, when the sources A and B are oriented such that the direction from A to B points upward, away from the ground, and the direction from B to A points toward the ground, the antenna is optimized for most applications. This is because it is rare that a user desires an antenna that directs signal strength toward the ground. This configuration is especially useful for satellite communications where it is desired that the majority of the signal strength be directed upward, away from the ground.

The point source antenna modeled in FIG. 10A is not readily achievable using conventional half wavelength helical antennas. Consider the antenna radiator portion illustrated in FIG. 3. The concentration of current strength at the ends of radiators 208 roughly approximates a point source. When radiators are twisted into a helical configuration, one end of the 90° radiator is positioned in line with the other end of the 0° radiator. Thus, this approximates two point sources in a line. However, these approximate point sources are separated by approximately $\lambda/2$ as opposed to the desired $\lambda/4$ configuration illustrated in FIG. 10A.

Note, however that the coupled radiator segment antenna according to the invention provides an implementation where the approximated point sources are spaced at a distance closer to $\lambda/4$. Therefore, the coupled radiator segment antenna allows users to capitalize on the directional characteristics of the antenna illustrated in FIG. 10A.

The radiator segments 708, 710 illustrated in FIG. 8 show that segment 708 is very near its associated segment 710, yet each pair of segments 708, 710 are relatively far from the adjacent pair of segments. In one alternative embodiment, each segment 710 is placed equidistant from the segments 708 on either side. This embodiment is illustrated in FIG. 11.

Figure 11:
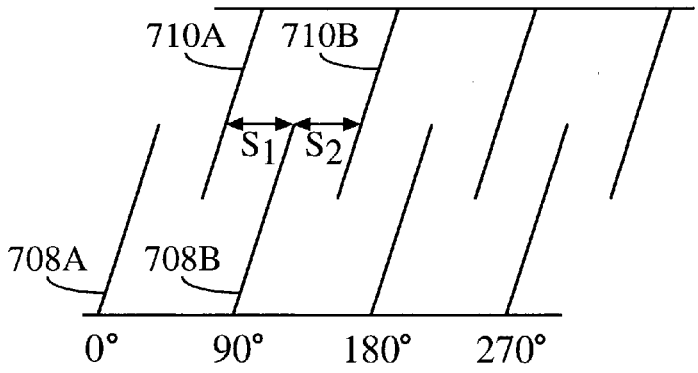
FIG. 11 is a diagram illustrating the embodiment in which each segment is placed equidistant from the segments on either side.

Referring now to FIG. 11, each segment is substantially equidistant from each pair of adjacent segments. For example, segment 708B is equidistant from segments 710A, 710B. That is, $s_1=s_2$. Similarly, segment 710A is equidistant from segments 708A, 708B.

This embodiment is counterintuitive in that it appears as if unwanted coupling would exist. In other words, a segment corresponding to one phase would couple not only to the appropriate segment of the same phase, but also to the adjacent segment of the shifted phase. For example, segment 708B, the 90° segment would couple to segment 710A (the 0° segment) and to segment 710B (the 90° segment). Such coupling is not a problem because the radiation from the top segments 710 can be thought of as two separate modes. One mode resulting from coupling to adjacent segments to the left and the other mode from coupling to adjacent segments to the right. However, both of these modes are phased to provide radiation in the same direction. Therefore, this double-coupling is not detrimental to the operation of the coupled multi-segment antenna.

Figure 12:
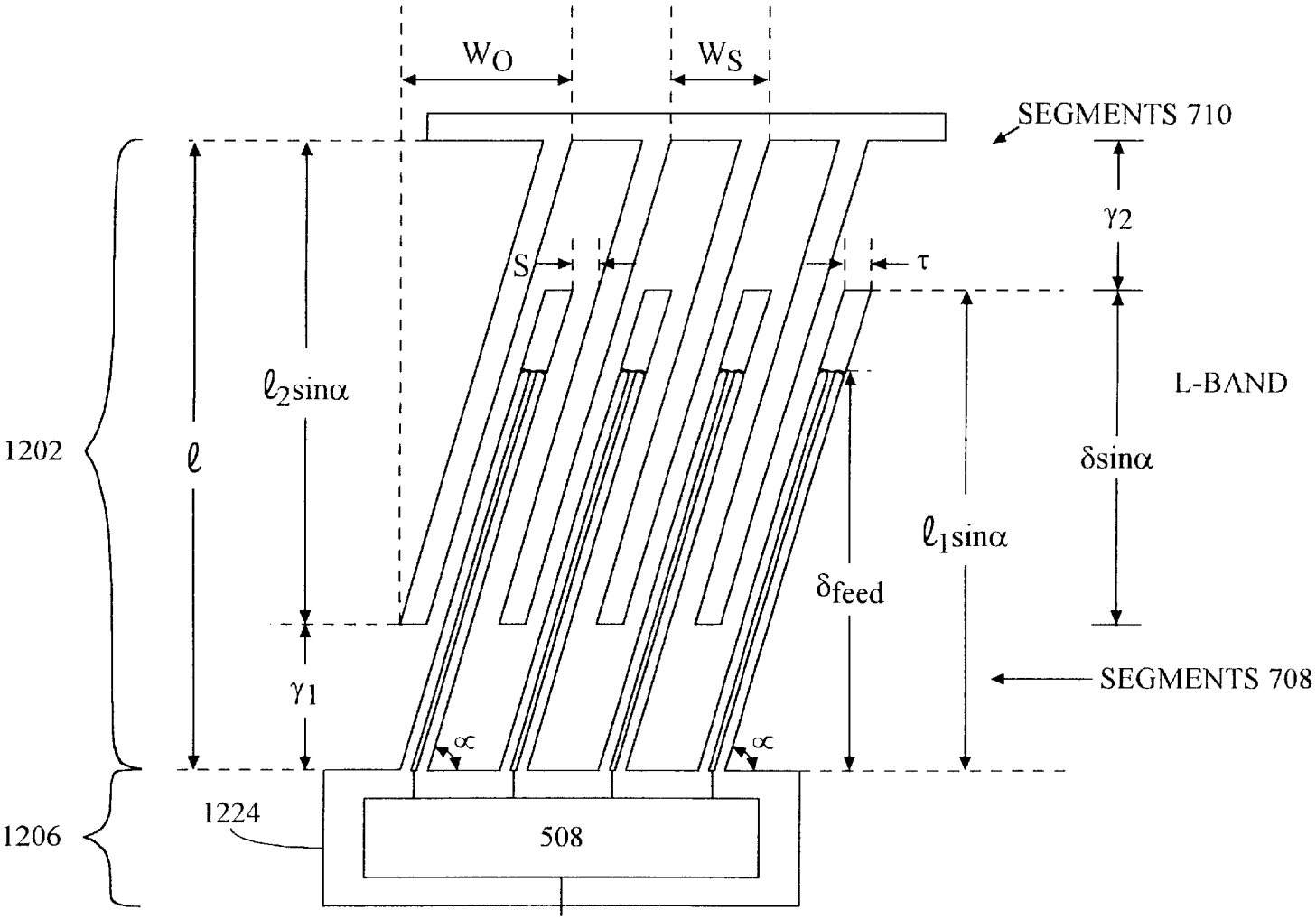
FIG. 12 is a diagram illustrating an example implementation of a coupled multi-segment antenna according to one embodiment of the invention.

FIG. 12 is a diagram illustrating an example implementation of a coupled radiator segment antenna. Referring now to FIG. 12, the antenna comprises a radiator portion 1202 and a feed portion 1206. Radiator portion includes segments 708, 710. Dimensions provided in FIG. 12 illustrate the contribution of segments 708, 710 and the amount of overlap 8 to the overall length of radiator portion 1202.

The length of segments in a direction parallel to the axis of the cylinder is illustrated as $l_1 \sin \alpha$ for segments 708 and $l_2 \sin \alpha$ for segments 710, where $\alpha$ is the inside angle of segments 708, 710.

Segment overlap as illustrated above in FIGS. 8A and 9A, is illustrated by the reference character $\delta$. The amount of overlap in a direction parallel to the axis of the antenna is given by $\delta \sin \alpha$, as illustrated in FIG. 12.

Segments 708, 710 are separated by a spacing s, which can vary as described above. The distance between the end of a segment 708, 710 and the end of radiator portion 1202 is defined as the gap and illustrated by the reference characters $\gamma_1$, $\gamma_2$, respectively. The gaps $\gamma_1$, $\gamma_2$ can, but do not have to be, equal to each other. Again, as described above, the length of segments 708 can be varied with respect to that of segments 710.

The amount of offset of a segment 710 from one end to the next is illustrated by the reference character $\omega_0$. The separation between adjacent segments 710 is illustrated by the reference character $\omega_s$, and is determined by the helix diameter.

Feed portion 1206 includes an appropriate feed network to provide the quadrature phase signals to the radiator segments 708. Feed networks are well known to those of ordinary skill in the art and are thus not described in detail herein.

In the example illustrated in FIG. 12, segments 708 are fed at a feed point that is positioned along each segment 708 a distance from the feed network that is chosen to optimize impedance matching. In the embodiment illustrated in FIG. 12, this distance is illustrated by the reference characters $\delta_{feed}$.

Note that continuous line 1224 illustrates the border for a ground portion on the far surface of the substrate. The ground portion opposite segments 708 on the far surface extends to the feed point. The thin portion of segments 708 is on the near surface. At the feed point, the thickness of segments 708 on the near surface increases.

Dimensions are now provided for an example coupled radiator segment quadrifilar helical antenna suitable for operation in the L-Band at approximately 1.6 GHz. Note that this is an example only and other dimensions are possible for operation in the L-Band. Additionally, other dimensions are possible for operation in other frequency bands as well.

The overall length of radiator portion 1202 in the example L-Band embodiment is 2.30 inches (58.4 mm). In this embodiment, the pitch angle $\alpha$ is 73 degrees. With this angle $\alpha$, the length of segments 708 $l_1 \sin \alpha$ for this embodiment is 1.73 inches (43.9 mm). In the embodiment illustrated, the length of segments 710 is equal to the length of segments 708.

In one example, segment 710 is positioned substantially equidistant from its adjacent pair of segments 708. In one implementation of the embodiment where segments 710 are equidistant from adjacent segments 708, the spacing $s_1=s_2=$ 0.086 inches. Other spacings are possible including, for example, the spacing s of segments 710 at 0.070 inches (1.8 mm) from an adjacent segment 708.

The width $\tau$ of radiator segments 708, 710 is 0.11 inches (2.8 mm) in this embodiment. Other widths are possible.

The example L-Band embodiment features a symmetric gap $\gamma_1=\gamma_2=0.57$ inches (14.5 mm). Where the gap $\gamma$ is symmetric for both ends of the radiator portion 1202 (i.e., where $\gamma_1=\gamma_2$), the radiators 708, 710 have an overlap $\delta \sin \alpha$ of 1.16 inches (29.5 mm) (1.73 inches–0.57 inches).

The segment offset $\omega_0$ is 0.53 inches and the segment separation $\omega_s$ is 0.393 inches (10.0 mm). The diameter of the antenna is $4\omega_s/\pi$.

In one embodiment, this is chosen such that the distance $_{feed}$ from the feed point to the feed network is $\delta_{feed}=1.57$ inches (39.9 mm). Other feed points can be chosen to optimize impedance matching.

Note that the example embodiment described above is designed for use in conjunction with a 0.032 inch thick polycarbonate radome enclosing the helical antenna and contacting the radiator portion. It will become apparent to a person skilled in the art how a radome or other structure affects the wavelength of a desired frequency.

Note that in the example embodiments just described, the overall length of the L-Band antenna radiator portion is reduced from that of a conventional half-wavelength L-Band antenna. For a conventional half-wavelength L-Band antenna, the length of the radiator portion is approximately 3.2 inches (i.e., $\lambda/2(\sin \alpha)$), where $\alpha$ is the inside angle of segments 708, 710 with respect to the horizontal), or (81.3 mm). For the example embodiments described above, the overall length of the radiator portion 1202 is 2.3 inches (58.42 mm). This represents a substantial savings in size over the conventional antenna.

V. Stacked Dual-Band Helical Antenna

Having thus described several embodiments of a single-band helical antenna, the present invention is now described. The present invention is directed toward a dual-band helical antenna capable of resonating at two different operating frequencies. According to the invention, two helical antennas are stacked end to end, with one antenna resonating at a first frequency and the other antenna resonating at a second frequency. Each antenna has a radiator portion comprised of one or more helically-wound radiators. Each antenna also has a feed portion comprised of a feed network and a ground plane. The two antennas are stacked such that the ground plane of one antenna is used as a shorting ring across the far end of the radiators of the other antenna.

Figure 13:
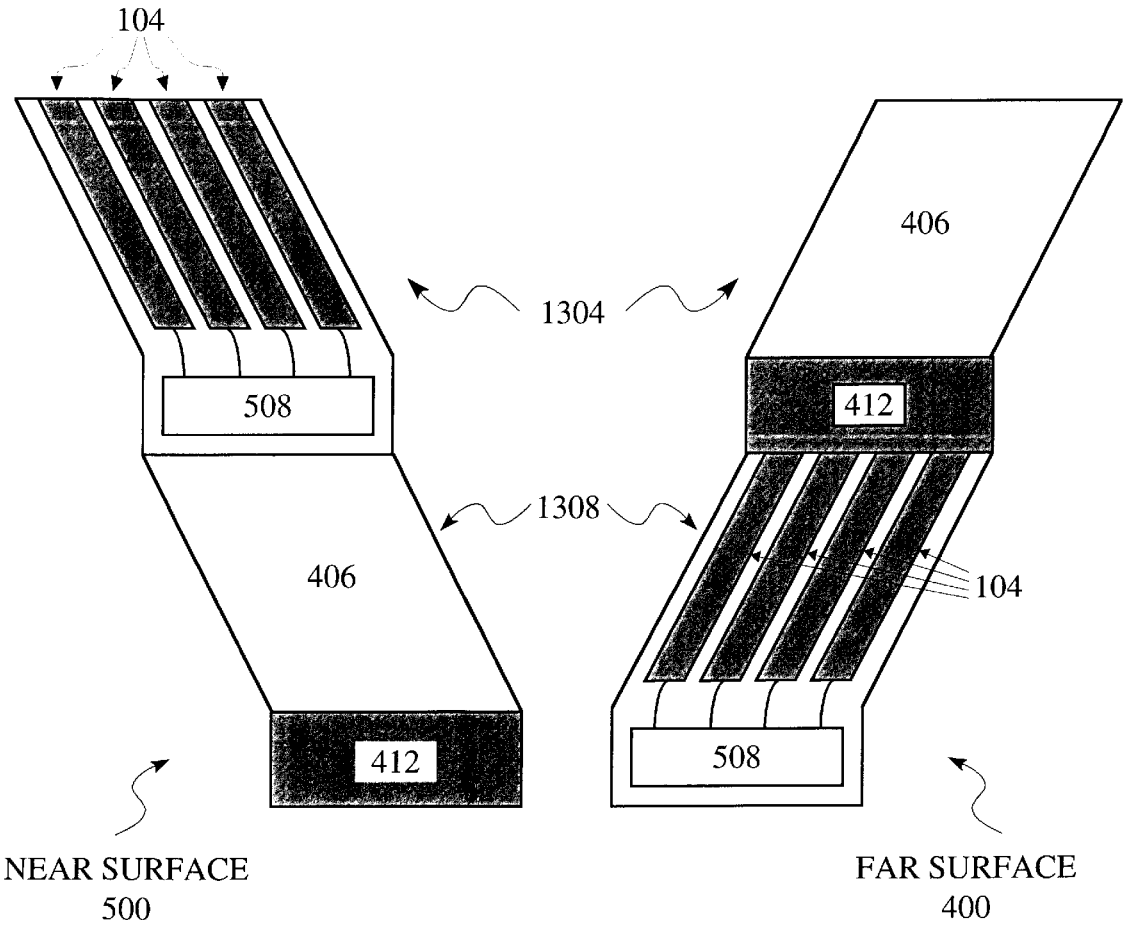
FIG. 13 is a diagram illustrating planar representations of the surfaces of a stacked dual-band helical antenna according to one embodiment of the invention.

FIG. 13 is a diagram illustrating planar representations of far surface 400 and near surface 500 of a dual-band helical antenna according to one embodiment of the invention. The dual-band helical antenna is comprised of two single-band helical antennas: helical antenna 1304 operating at a first resonant frequency and helical antenna 1308 operating at a second resonant frequency.

In the embodiment illustrated in FIG. 13, feed network 508, radiators 104A–104D and first antenna 1304 are disposed on near surface 500 of first antenna 1304. Also disposed on near surface 500 is the ground plane 412 for the feed network 508 of second antenna 1308. On far surface 400 are feed network 508 and radiators 104A–104D of second antenna 1308 as well as ground plane 412 for the feed portion of first antenna 1304.

As discussed above with reference to FIGS. 2A and 2B, where the resonant length l of radiators 104A–104D is an even integer multiple of a quarter-wavelength of the desired resonant frequency, the far end of the radiators 104A–104D is shorted. As illustrated in FIG. 13, according to one aspect of the invention this shorting is accomplished using ground plane 412 of first antenna 1304. As a result of this configuration, an additional shorting ring does not need to be added to the end of radiators 104A–104D.

Note that in the embodiment illustrated in FIG. 13, first antenna 1304 is illustrated as resonating at odd integer multiples of a quarter-wavelength of the desired resonant frequency because the ends of radiators 104A–104D are open circuited. In an alternative embodiment, a shorting ring (not illustrated) could be added to the far end of radiators 104A–104D of first antenna 1304, while changing the length of these radiators 104A–104D such that they are an even-integer multiple of a quarter-wavelength of the desired resonant frequency.

Figure 14:
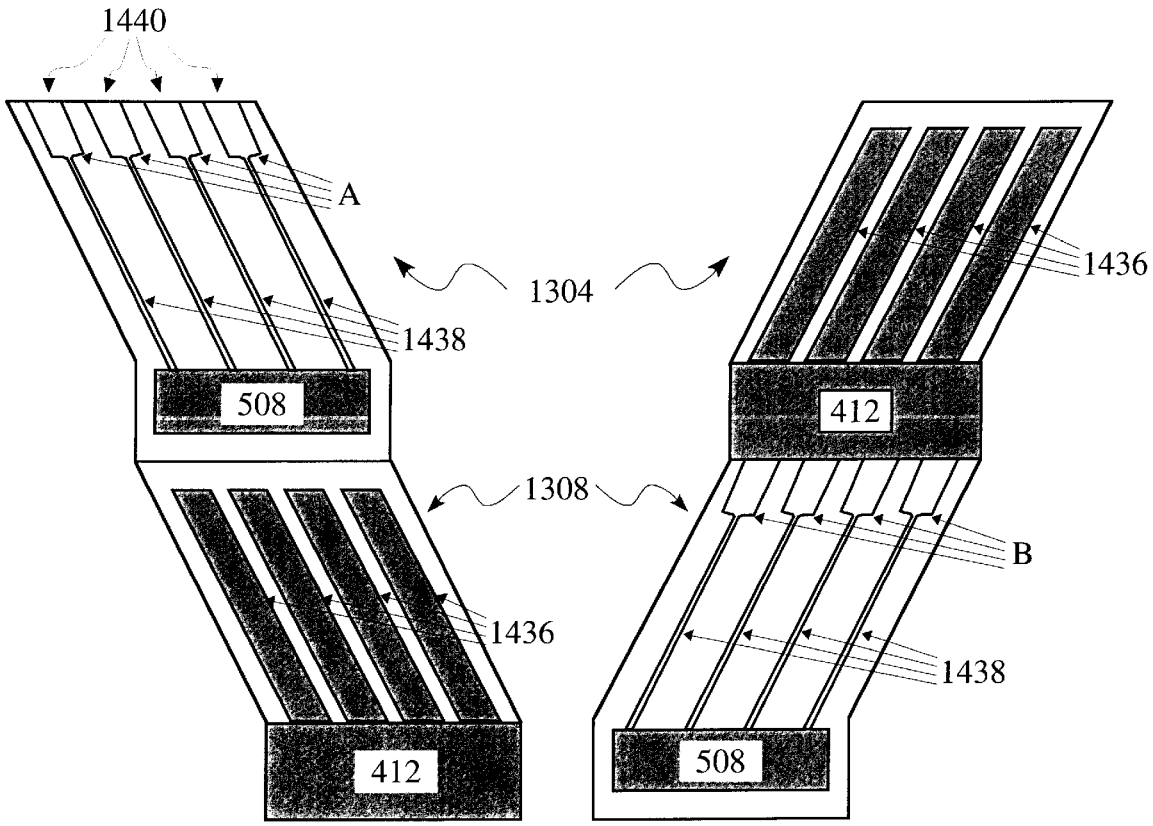
FIG. 14 is a diagram illustrating planar representations of the surfaces of a stacked dual-band helical antenna according to one embodiment of the invention in which the feed points for the radiators are positioned at a distance from the feed network.

Radiators 104A–104D of the dual-band antenna described with reference to FIG. 13 are illustrated as being fed at a first end near feed network 508. It is well known that a feed point of radiators 104A–104D of the helical antenna can be positioned at any point along the length of radiators 104A–104D where such positioning is primarily determined based on impedance matching considerations. FIG. 14 is a diagram illustrating one embodiment of a dual-band helical antenna in which the feed points of radiators 104A–104D are positioned at a predetermined distance from feed network 508. Specifically, in the embodiment illustrated in FIG. 14, a feed point A of first antenna 1304 is positioned at a distance $l_{FEED1}$ from feed network 508 and feed point B of second antenna 1308 is positioned at a distance $l_{FEED2}$ from feed network 508.

This embodiment illustrates that radiators 104A–104D are comprised of a ground trace 1436 on a first surface of the substrate 406, a feed trace 1438 on a second surface of substrate 406 and opposite said ground trace 1436, and a radiator trace 1440 on the second surface of substrate 406.

As with the embodiment illustrated in FIG. 13, in this embodiment, ground plane 412 of first antenna 1304 serves as a shorting ring for radiators 104A–104D and second antenna 1308 such that the radiators of second antenna 1308 resonate at an even integer multiple of a quarter-wavelength of the desired resonant frequency.

In order to decrease the overall length of the stacked antenna, the edge-coupled technology discussed above can be utilized. In such embodiments, radiators 104A–104D of first antenna 1304 and/or second antenna 1308 as illustrated in FIGS. 13 and 14 are replaced with edge-coupled radiators as illustrated, for example, in FIG. 12.

One challenge of providing a dual-band antenna such as that illustrated in FIGS. 13 and 14 is that of feeding first antenna 1304. According to one embodiment of the invention, first antenna 1304 is fed by means of a tab extending from the lower area of the feed portion of first antenna 1304.

Figure 15:
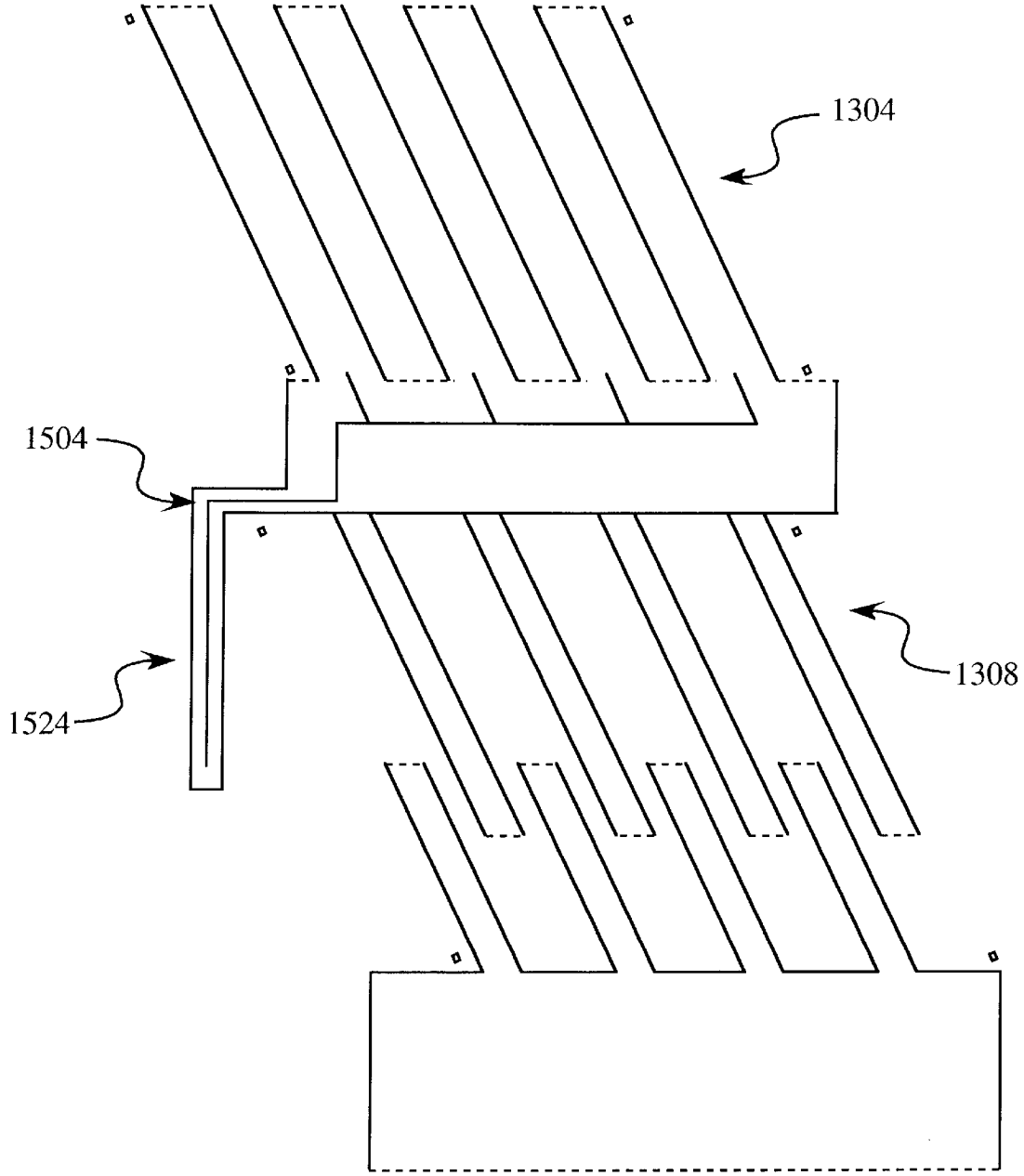
FIG. 15 is a diagram illustrating a planar representation of a tab used to feed one antenna of the stacked dual-band helical antenna according to one embodiment of the invention.

FIG. 15 is a diagram illustrating such a tab used to feed first antenna 1304. Referring now to FIG. 15, a tab 1504 extends from the side of the feed portion of first antenna 1304 on substrate 406. In the embodiment illustrated in FIG. 15, tab 1504 is approximately "L" shaped such that it extends horizontally from the feed portion of first antenna 1304 at a given distance and is then angled axially through the center in the direction of the feed portion of second antenna 1308. Although 1504 is illustrated as being shaped with a right angle, other angles could be used as could curves of various radii.

Ideally, when substrate 406 is rolled into a cylinder or other appropriate shape to form the helical antenna, axial component 1524 of tab 1504 is substantially along the axis of the dual-band helical antenna. Having axial component 1524 of tab 1504 coincident with the axis of the helical antenna minimizes the impact of this member on the radiation patterns of the antenna. As illustrated in FIG. 15, in a preferred embodiment, tab 1504 extends from feed portion of first antenna 1304 at a vertical position that is as far as possible from first antenna 1304. This is done to minimize the effect of tab 1504 on the radiation patterns of first antenna 1304. Because second antenna 1308 is a coupled-segment one-half wavelength antenna and the ends of radiators 104A–104D of second antenna 1308 are shorted by ground plane 412 of first antenna 1304, tab 1504 has a minimal effect on the radiation patterns of second antenna 1308.

Preferably, the length $l_{gp}$ of feed portion 1206 of first antenna 1304 can be determined by considering two factors at the appropriate operating frequency. First, it is desirable to minimize the amount of current flowing from the radiators of first antenna 1304 to second antenna 1308, and vice versa. In other words, it is desirable to achieve isolation between the two antennas. This can be accomplished by ensuring that the length is great enough such that the currents do not extend form one set of radiators to the other at the frequency of interest.

The second factor is the goal of not allowing current from radiators 104A–D of first antenna 1304 from reaching tab 1504. Currents from first antenna 1304 are attenuated as they travel across the feed portion of first antenna 1304 toward tab 1504. Tab 1504 creates an asymmetrical discontinuity in these currents. Therefore, it is desired to minimize the magnitude of the currents reaching tab 1504 to the extent practical.

After reading this description, it will become apparent to a person skilled in the art how to implement feed portion 1206 of appropriate length $l_{gp}$ based on the materials used, the frequencies of interest, the expected power levels in the antenna, and other known factors. This decision may also entail a tradeoff between size and performance.

Note that the effects of tab 1504 are not non-existent in this embodiment. Because tab 1504 is close to the radiators of second antenna 1308, some current from second antenna 1308 is coupled into tab 1504, and, therefore, along the axis of the antenna. This current affects the radiation of second antenna 1308, resulting in increased radiation to the sides of the antenna. For applications where the antenna is mounted vertically, this results in increased radiation in the direction of the horizon and decreased radiation in the vertical direction. As a result, this application is well-suited for satellite communication systems where low-earth-orbiting satellites are used to relay communications from or to the communication device.

Figure 10C:
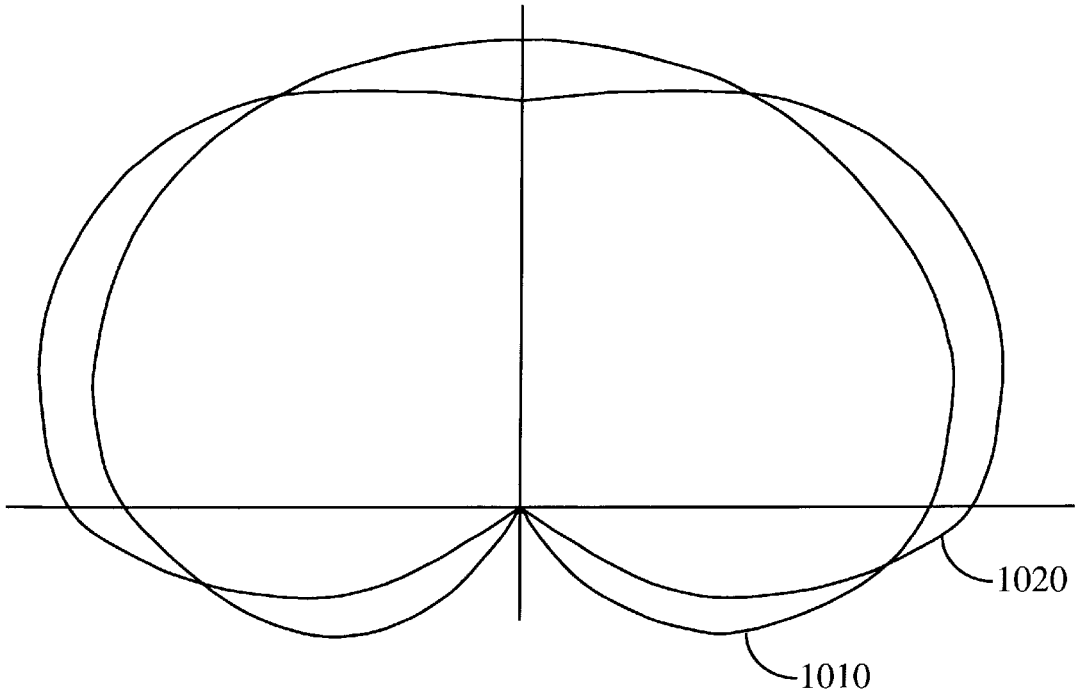
FIG. 10C is a diagram illustrating circular polarization field patterns for a conventional helical antenna and circular polarization field patterns for a helical antenna having a feed tab aligned with the axis of the antenna.

This effect is illustrated in FIG. 10C, where circular polarization radiation pattern 1010 is a representation of a typical radiation pattern for a conventional helical antenna, and radiation pattern 1020 is a representation of a radiation pattern for second antenna 1308. As FIG. 10C illustrates, pattern 1020 is "flatter" and "wider" than conventional pattern 1010.

To enable coupling of a signal to first antenna 1304, tab 1504 includes a connector such as a crimp or solder connector or other connector suitable for making a connection between a feed cable and the signal trace on tab 1504. Various types of cable or wire can be used to connect transceiver RF circuitry to the antenna at tab 1504. Preferably a low loss flexible or semi-rigid cable is utilized. Of course, as is well known in the antenna art, it is desired to match the impedance of the feed input with that of the interface cable to maximize power transfer to the antenna. However, if the input transition is poor, the radiation patterns will still be symmetric, only their gains will be lowered by the corresponding amount of reflection loss. In addition to a low insertion loss, it is also important that the connector provide a sturdy mechanical connection between the cable and tab 1504.

Also illustrated in FIG. 15 is the outline for an example substrate shape. After reading this description, it will become apparent to a person skilled in the art how to implement the antenna with a tab 1504 utilizing substrates having other shapes.

Figure 16:
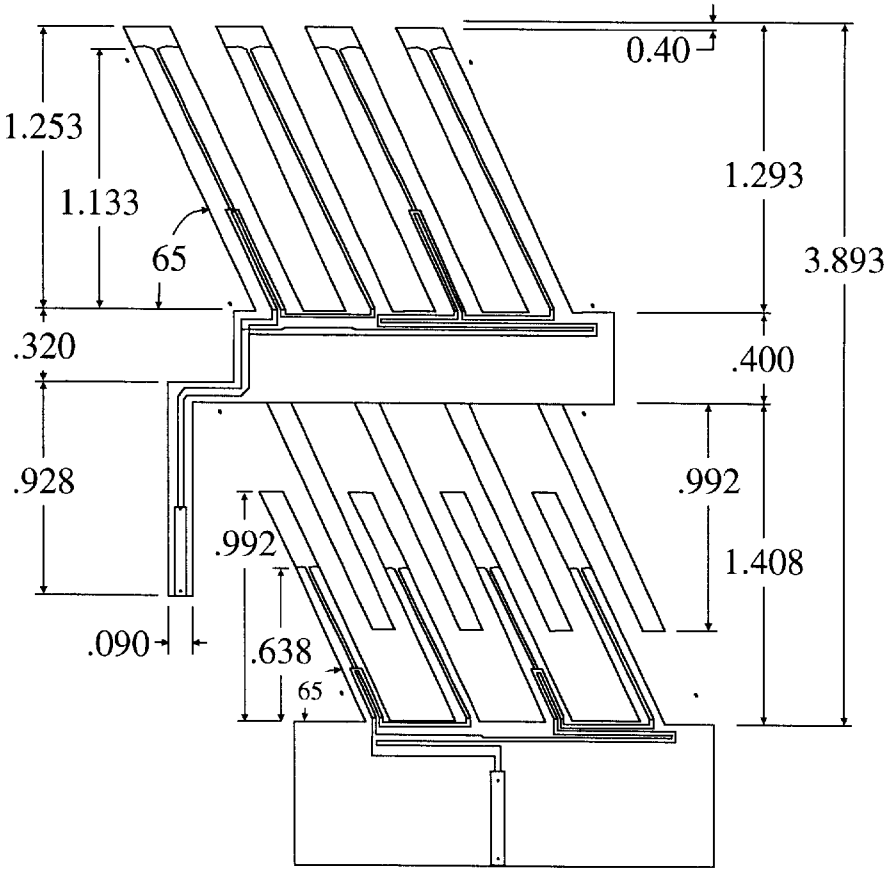
FIG. 16 is a diagram illustrating example dimensions for a stacked dual-band helical antenna according to one embodiment of the invention.

FIG. 16 is a diagram illustrating one embodiment of a stacked antenna with example dimensions. In this embodiment, first antenna 1304 is an L-band antenna and second antenna 1308 is an S-band antenna. In this embodiment, S-band antenna 1308 is an edge-coupled antenna wherein each radiator 104 is comprised of two segments. Note that this embodiment is provided for example only. Alternative frequency bands can be chosen for operation. Also note that either first antenna 1304 or second antenna 1308 or both could utilize the edge-coupled technology.

Example dimensions are now described for the L-band and S-band antenna illustrated in FIG. 16. The radiating aperture of the L-band antenna is a total axial height of 1.253 inches, while the S-band aperture is a total height of 1.400 inches. In this embodiment, the height of feed portion 412 of first antenna 1304 is 0.400 inches. This yields a total radiating aperture of 3.093 inches. The inclination angle of radiators 104A–104D is 65°.

The above dimensions are provided by way of example only. As discussed above with reference to conventional helical antennas, the overall length of radiators 104A–104D determines the precise resonating frequency of the antenna. The resonating frequency is important because the highest average gains and the most symmetric patterns occur at the resonant frequency. If the antenna is made longer, the resonating frequency shifts down. Conversely, if the antenna is made shorter, the resonating frequency shifts up. The percentage of the frequency shift is approximately proportional to the percentage that the radiators 104A–104D are lengthened or shortened. At L-band operating frequencies, roughly 1 mm of length in the direction of the antenna axis corresponds to 1 MHz.

In the illustrated embodiment, both first antenna 1304 and second antenna 1308 have four excited filar arms, or radiators 104A–104D. Each of these radiators 104A–104D are fed in phase quadrature. The quadrature phase excitation of four radiators 104A–104D for each antenna 1304, 1308 is implemented using a feed network. While conventional feed networks capable of providing quadrature phase excitation can be implemented, a preferred feed network is discussed in detail below.

Another important dimension is the feedpoint axial length. The feedpoint axial length defines the distance of the feedpoint from the feed network for embodiments where the feedpoint is positioned along radiators 104A–104D as illustrated in FIG. 13. The feedpoint axial length dimension indicates the position at which the microstrip flares out to continue the radiator and is actually the feedpoint position for the entire radiator 104. In the example illustrated in FIG. 16, the feedpoint length for first antenna 1304 is 1.133 inches. The feedpoint length for second antenna 1308 is 0.638 inches. These dimensions yield 50 ohm impedances at 1618 and 2492 MHz, respectively. If the feedpoint position is shifted lower, the impedance is lower. Conversely, if the feedpoint position is shifted higher, the impedance is higher. It is important to note that when the overall radiator length is being adjusted to tune the frequency, the feedpoint position should also be shifted by a proportional amount in the direction along the axis of the antenna to maintain the correct impedance match.

Preferably, the antenna having dimensions as illustrated in FIG. 16 is rolled into a cylinder having a diameter of 0.500 inches.

VI. Feed Network

The helical antennas described in this document can be implemented using a mono-filar, quadrifilar, octafilar or other x-filar configuration. A feed network is utilized to provide the signals to the filars at the necessary phase angle. The feed network splits the signal and shifts the phase provided to each filar. The configuration of the feed network is dependent on the number of filars. For example, for a quadrifilar helical antenna, the feed network provides four equal-power signals in a quadrature phase relationship (i.e. 0, 90, 180, and 270 degrees).

To conserve space on the feed portion of the antenna, the present invention utilizes a unique feed network layout. According to the invention, the traces of the feed network extend into one or more radiators 104A–104D of the antenna. For convenience, the feed network according to the invention is described in terms of a feed network designed to provide four equal-power signals in a quadrature phase relationship. After reading this description, it will become apparent to a person skilled in the relevant art how to implement the feed network for other x-filar configurations.

Figure 17:
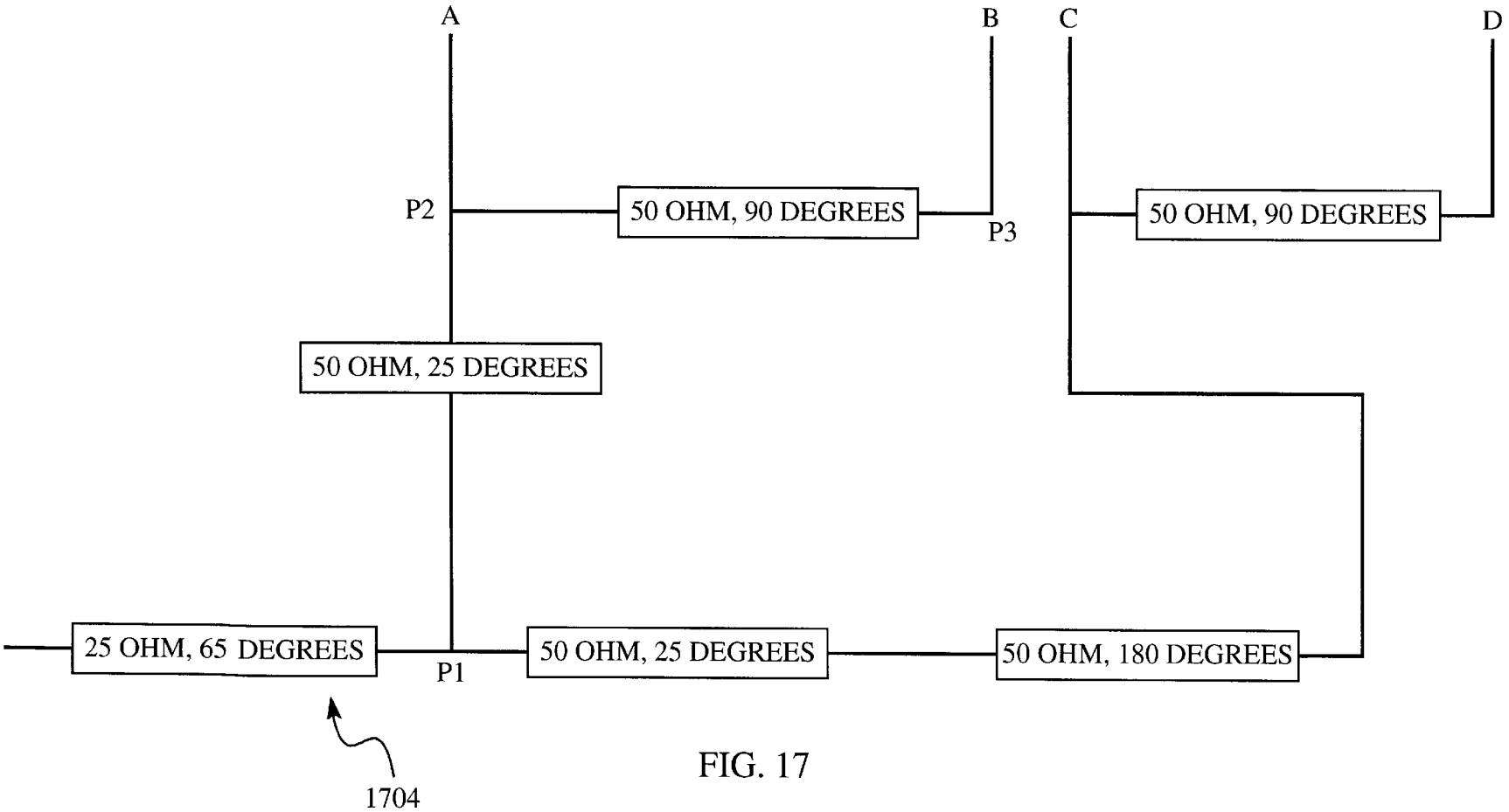
FIG. 17 is a diagram illustrating an example of a conventional quadrature phase feed network.

FIG. 17 illustrates the electrical equivalent of a conventional quadrature phase feed network. For conventional quadrature phase feed networks, the network provides four equal-power signals, each separated in phase by 90 degrees. The signal is provided to the feed network via a first signal path 1704. At a first signal point A (referred to as a secondary feed point), the 0-degree phase signal is provided to a first radiator 104. At signal point B, the 90-degree phase signal is provided to a second radiator 104. At signal points C and D, the 180- and 270-degree phase signals are provided to third and fourth radiators 104.

Signals A and B are combined at a point P2 to yield a 25-ohm impedance. Likewise, signals C and D are combined at a point P3 to yield a 25-ohm impedance. These signals are combined at P1 to yield a 12.5-ohm impedance. Therefore, a 25-ohm, 90-degree transformer is placed at the input to convert this impedance to 50-ohms. Note that in the network illustrated in FIG. 17, part of the transformer is placed before the P1 split to shorten the feed and also to decrease losses. However, because it is before the split, it must be twice the impedance after the split.

According to the invention, the conventional feed network is modified such that the traces of the feed network are disposed on portions of the substrate defined for radiators 104A–104D. Specifically, in a preferred embodiment, these traces are disposed on the substrate in an area which is opposite from the ground traces of the one or more of the radiators 104A–104D.

Figure 18:
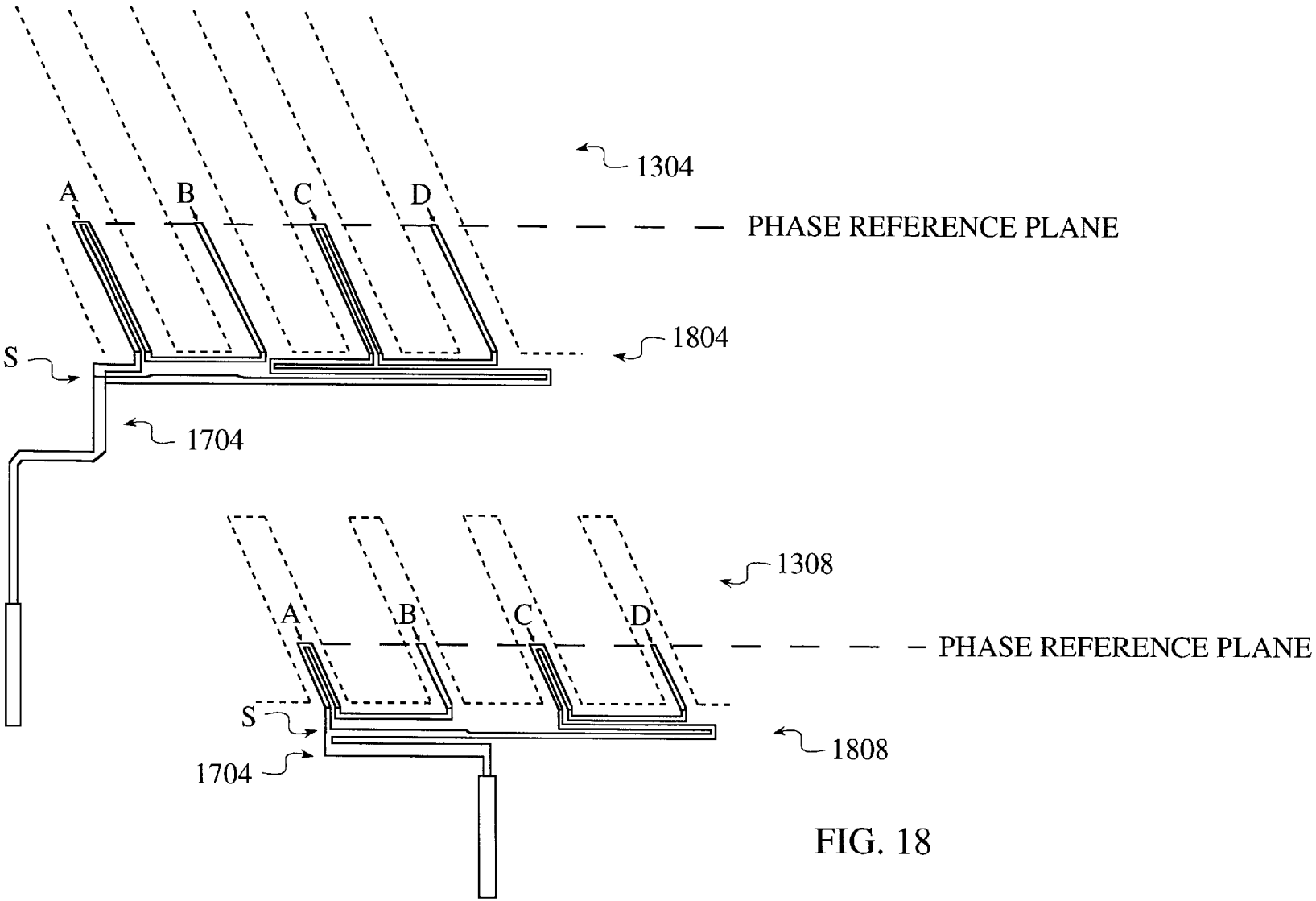
FIG. 18 is a diagram illustrating a feed network having portions that extend into the radiators of the antenna according to one embodiment of the invention.

FIG. 18 is a diagram illustrating an example embodiment of the feed network in a quadrifilar helical antenna environment. Specifically, in the example illustrated in FIG. 18, two feed networks are illustrated: a first feed network 1804 for implementation with first antenna 1304; and a second feed network 1808 for implementation with second antenna 1308. Feed networks 1804, 1808 have points A, B, C, and D, for providing the 0, 90, 180, and 270-degree signals to radiators 104A–104D. The dashed lines provided on FIG. 18 approximately illustrate an outline for the ground plane of radiators 104A–104D on a surface of the substrate opposite the surface on which feed networks 1804, 1808 are disposed. Thus, FIG. 18 illustrates those portions of feed networks 1804, 1808 which are disposed on, or extend into, radiators 104A–104D.

Note that according to conventional wisdom, the feed network is provided on an area that is designated for the feed network and that is separate from the radiators. In contrast, the feed network according to the invention is laid out such that a portion of the feed network is deposited on the radiator portion of the antenna. As such, the feed portion of the antenna can be reduced in size in comparison to the feed portion for a conventional feed networks.

Figure 19:
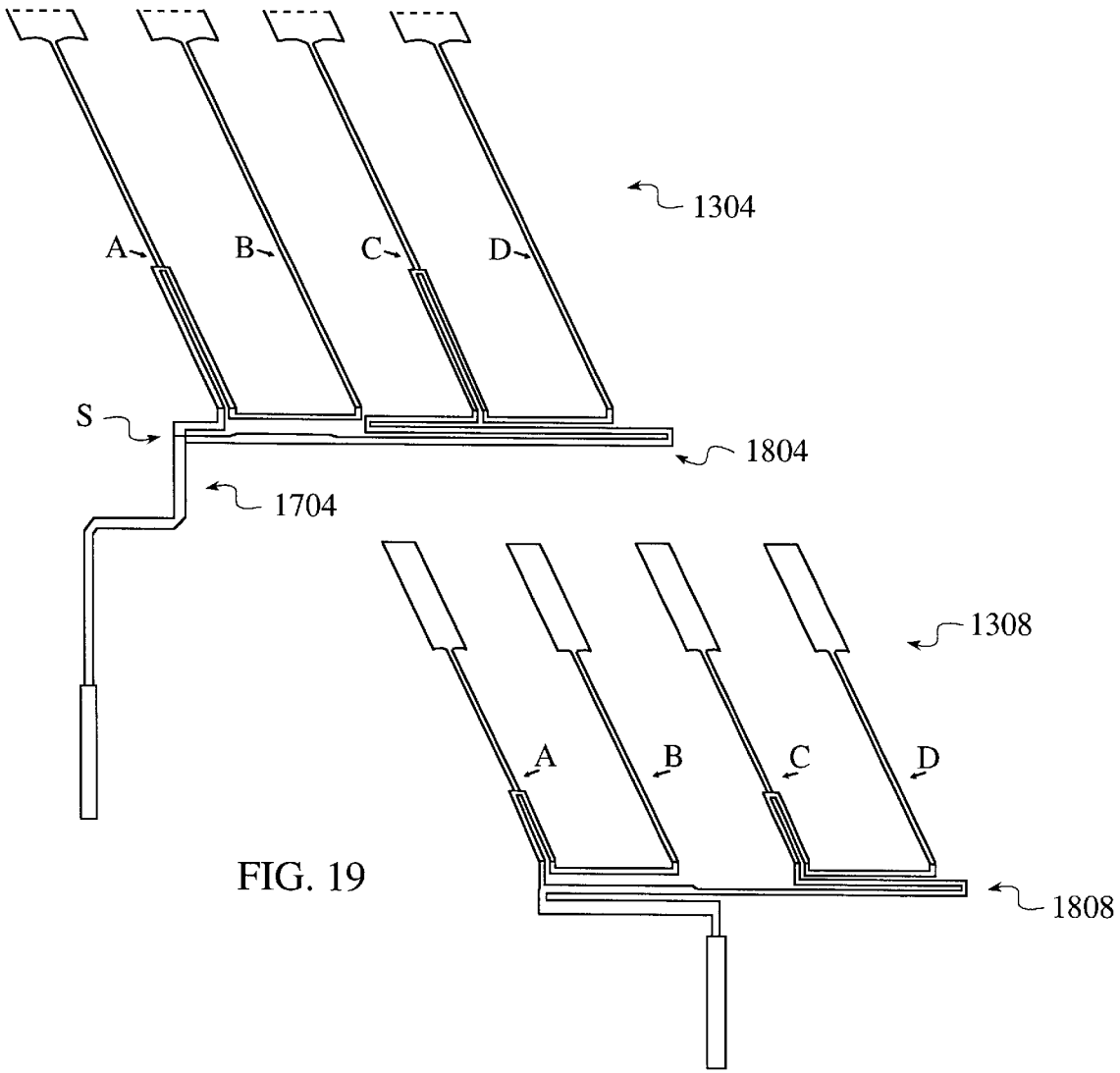
FIG. 19 is a diagram illustrating feed networks along with the signal traces, including the feed paths, for antennas according to one embodiment of the invention.
Figure 20:
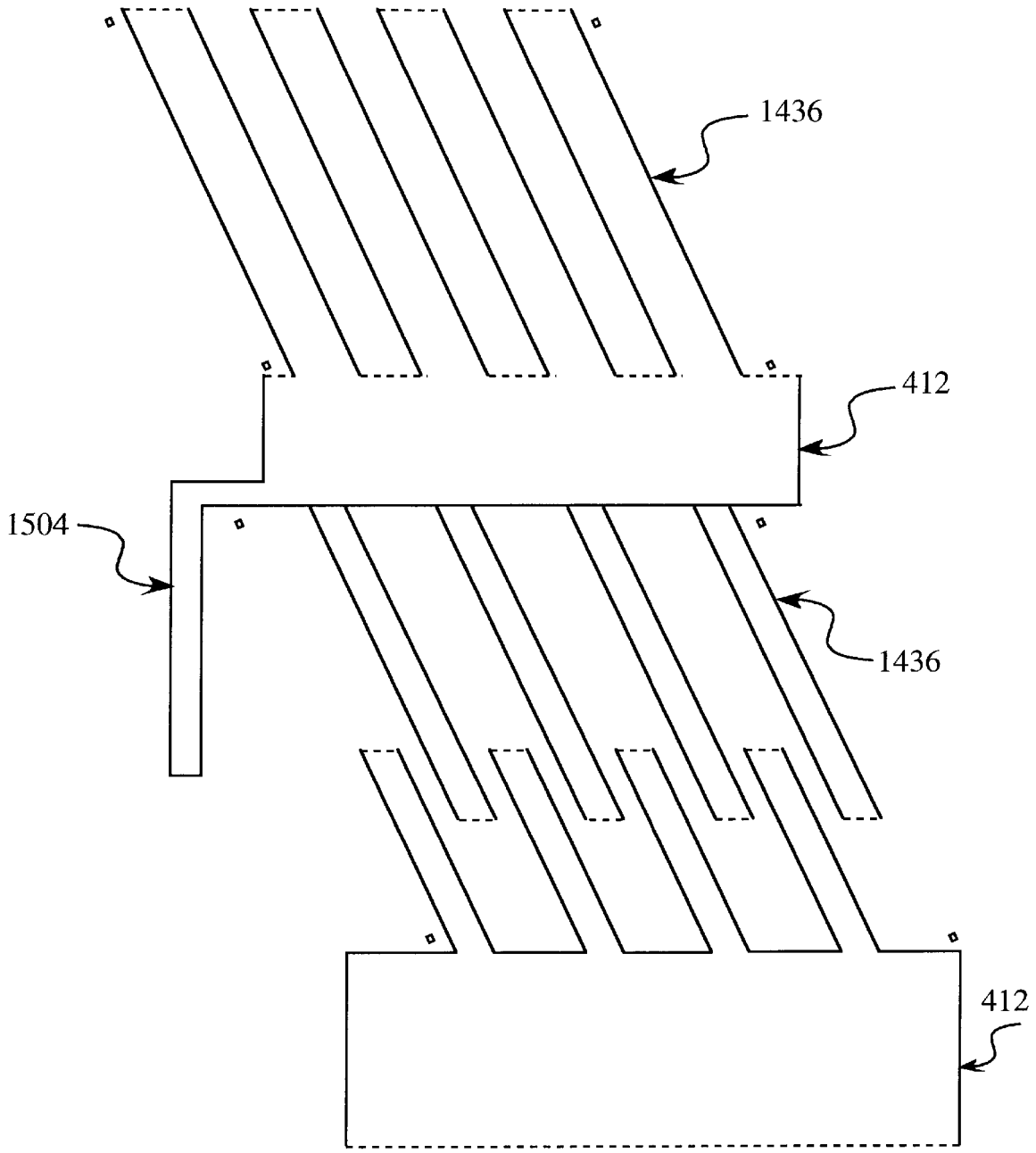
FIG. 20 is a diagram illustrating an outline for the ground plane of antennas according to one embodiment of the invention.
Figure 21:
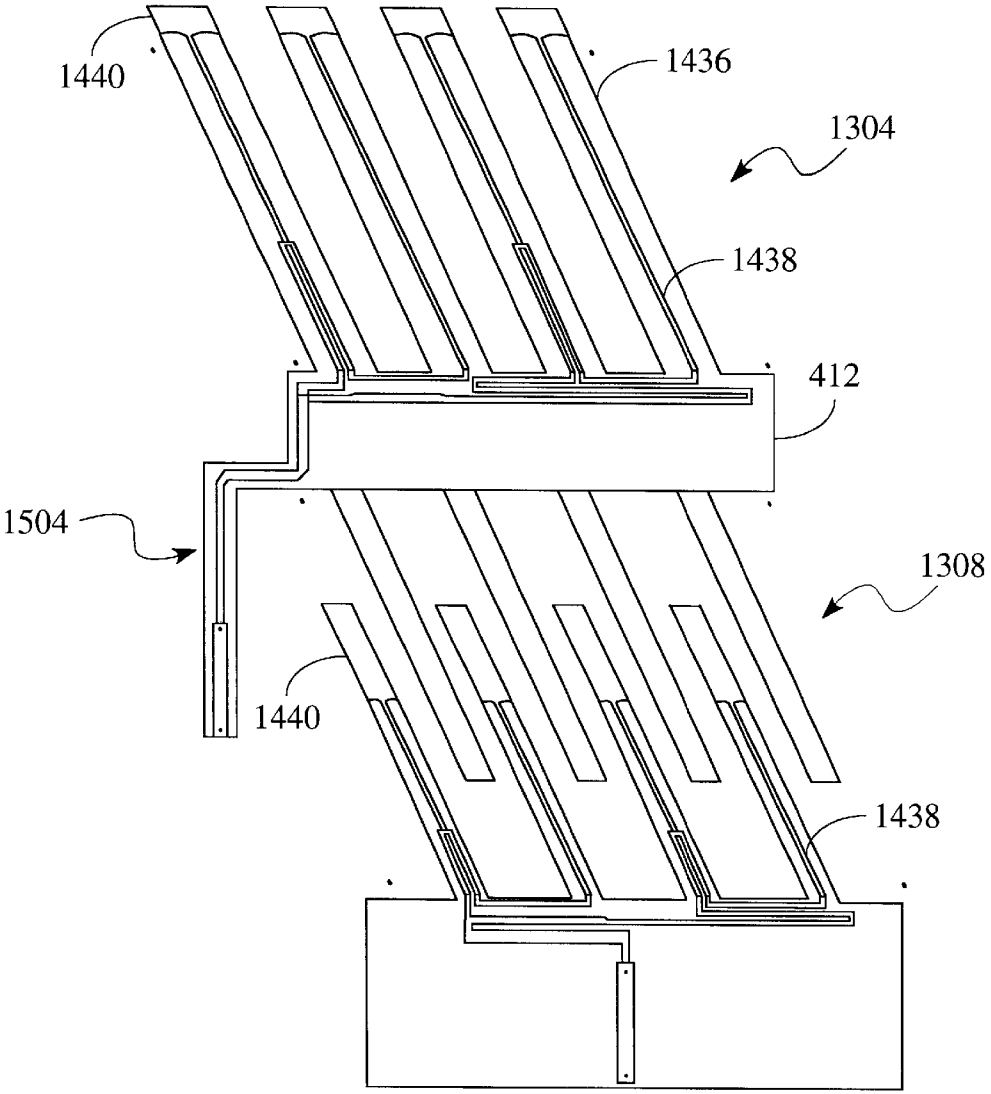
FIG. 21 is a diagram illustrating both the ground planes and the signal traces of a dual band antenna superimposed according to one embodiment of the invention.

FIG. 19 is a diagram illustrating feed networks 1804, 1808 along with the signal traces, including the feed paths, for antennas 1304, 1308. FIG. 20 illustrates an outline for the ground plane of antennas 1304, 1308. FIG. 21 is a diagram illustrating both the ground planes and the signal traces superimposed.

An advantage of these feed networks is that the area required for the feed portion of the antenna to implement a feed network is reduced over conventional feeding techniques. This is because portions of the feed network which would otherwise be disposed on the feed portion of the antenna are now disposed on the radiator portion of the antenna. As a result of this, the overall length of the antenna can be reduced.

An additional advantage of such a feed network is that because the secondary feed point is moved closer to the feed point of the antenna, transmission line loss is decreased. Additionally, a transformer can be integrated into the routing line of the feed network for impedance matching.

VII. Antenna Assembly

As described above, one technique for manufacturing helical antennas is to dispose radiators, feed networks and ground traces on a substrate and to wrap the substrate in an appropriate shape. Although the above-described antenna configurations can be implemented using conventional techniques for wrapping the substrate in the appropriate shape, an improved structure and technique for wrapping the substrate is now described.

Figure 22A:
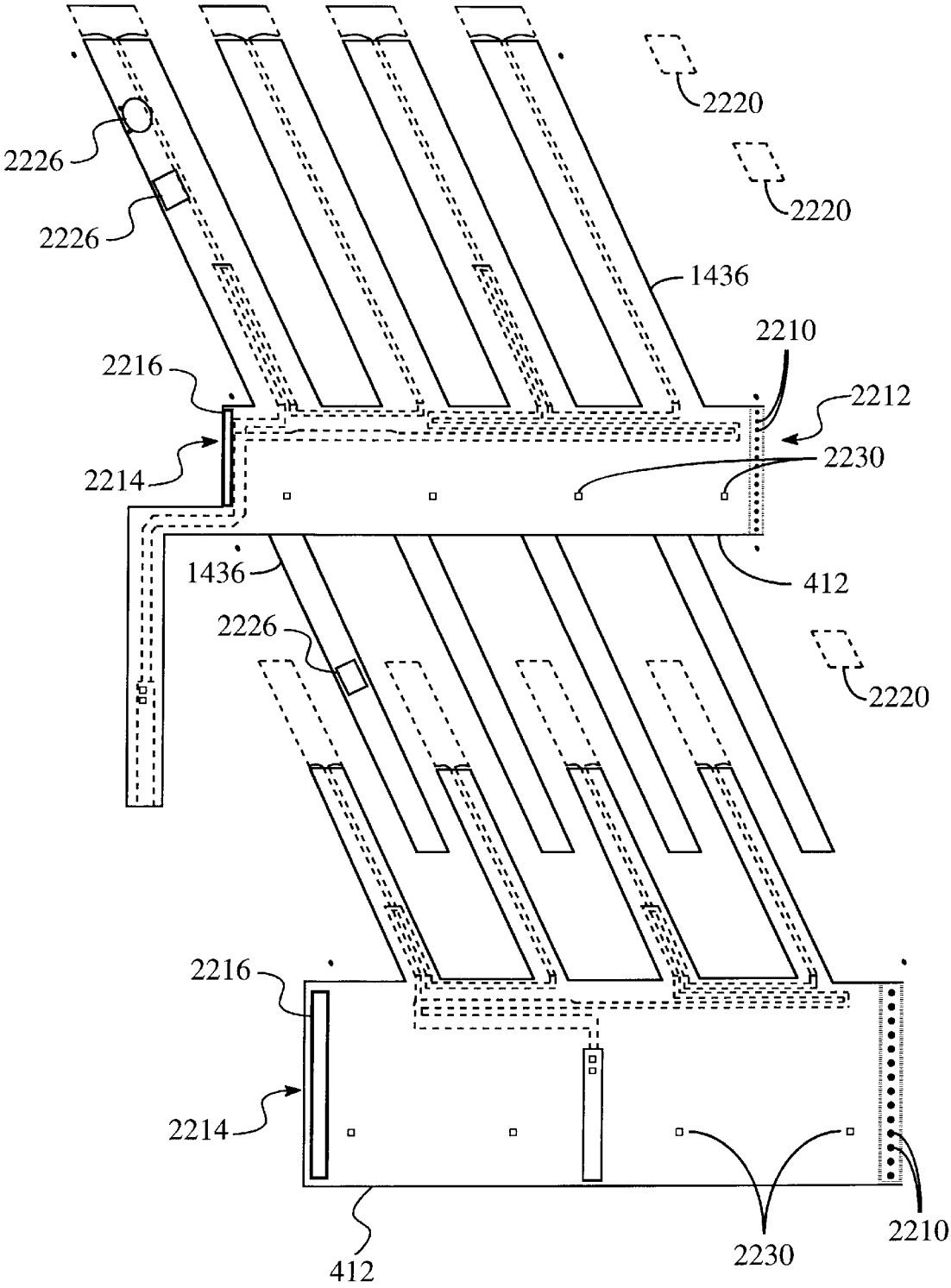
FIG. 22A is a diagram illustrating a structure for maintaining an antenna in a cylindrical or other appropriate shape according to one embodiment.

FIG. 22A is a diagram illustrating one embodiment of a structure used to maintain the substrate in an appropriate (e.g., cylindrical) shape. More specifically, FIG. 22A illustrates an example structure added to an antenna having an area efficient feed network. After reading this description, it will become apparent to a person skilled in the relevant art how to implement the invention with helical antennas of other configurations.

FIGS. 22B through 22F depict cross-sectional views of an example structure used to hold the antenna in a cylindrical or other appropriate shape. Referring now to FIGS. 22A through 22F, the example includes a metallic strip 2218 on, or as an extension of, ground plane 412, solder material 2216 opposite metallic strip 2218, and one or more vias 2210.

Metallic strip 2218 can be comprised of a portion of ground plane 412, or a metallic strip added to ground plane 412. Preferably, in one embodiment, metallic strip 2218 is provided by merely extending the width of ground plane 412 by a predetermined amount. In the embodiment illustrated in FIG. 22A, this width is shown by $\omega_{strip}$. A series of vias 2210 are provided in ground plane 412 in the area of metallic strip 2218. Preferably, for a solid connection, the vias 2210 are added to radiator portions of both first antenna 1304 and second antenna 1308. The pattern chosen for vias 2210 is based on known mechanical and electrical properties of the materials used. While the invention can be implemented with only one or two vias 2210 on each ground plane 412, to obtain a desired level of mechanical strength and electrical connection several vias 2210 may be employed. While not necessary, the portion of each ground plane 412 used can extend laterally, or circumferentially, beyond the antenna radiators.

Figure 22B:
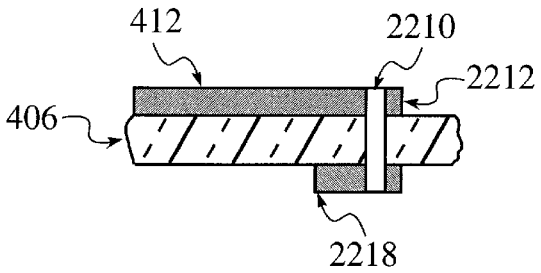
FIGS. 22B–22F are diagrams illustrating the formation of an antenna in a cylindrical or other appropriate shape according to the embodiment illustrated in FIG. 22A.
Figure 22C:
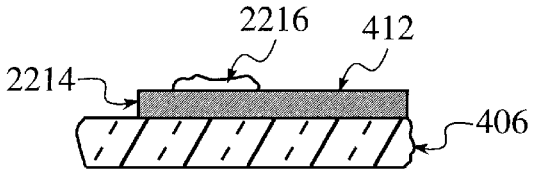

As seen in FIG. 22B, vias 2210 extend completely through the material of ground plane 412 and through support substrate 406 (100) from one surface to the next. The vias are manufactured as metallized or metal coated vias using well known techniques in the art. A relatively small portion or region of an opposite edge 2214 of ground plane 412 is coated with solder material 2216.

Figure 22D:
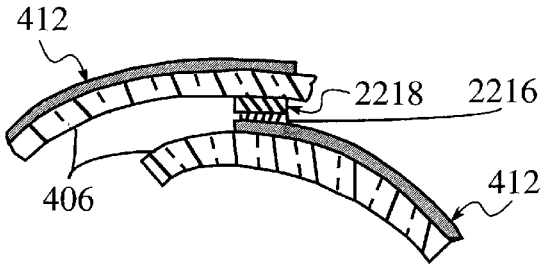

The embodiments illustrated in FIGS. 22B and 22D, include a small metallic strip 2218 formed on substrate 406 on the opposite side from ground plane 412, but adjacent to first edge 2212. In this embodiment, the vias extend through the substrate to metallic strip 2218. While metallic strip 2218 is not necessary in all applications, it will be readily apparent to those skilled in the art that metallic strip 2218 facilitates solder flow and improved mechanical bonding. A specific material for manufacturing metallic strip 2218 is chosen according to known principles based on the ground plane material being used, the solder chosen, and so forth.

When the antenna support substrate is rolled into the generally cylindrical shape to form desired helical antenna structures, edges 2212 and 2214 are brought into close proximity with one another as illustrated in FIG. 22D. Vias 2210 and metallic strip 2218 (if provided) are positioned to overlap solder material 2216 on opposite ground plane edge 2214. Heat is applied using well known soldering techniques and equipment while strip 2218 is held in contact with solder material 2216.

As solder material 2216 is melted, it flows into vias 2210 and onto metallic strip 2218. The heat is then reduced or removed, and the solder forms a permanent, but removable or serviceable, joint or bond between the two outer edges or ends of ground plane 412. In this manner, the antenna support substrate 406 and the antenna components deposited thereon are now mechanically held in the desired cylindrical form without requiring other materials such as dielectric tape, adhesives, or the like. This reduces the time, cost, and labor previously required to assemble a helical antenna of this type. This may also allow increased automation of this operation and provide more; readily reproducible antenna dimensions. In addition, one edge of ground plane 412 is now electrically connected to the other edge, providing a continuous conductive ring from the ground plane, as desired. This electrical connection is accomplished without complicated soldering or connecting wires.

Figure 22E:
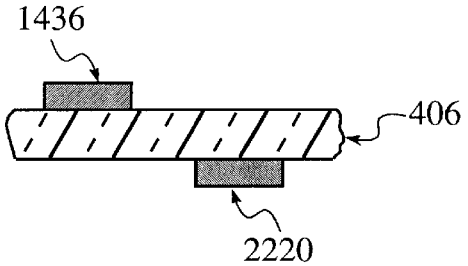
Figure 22F:
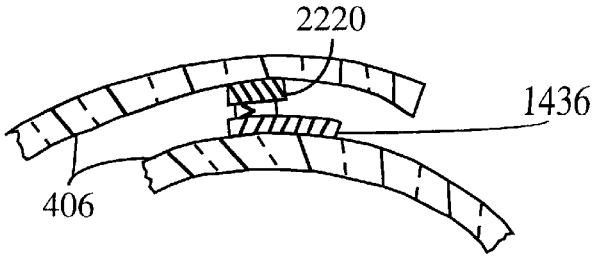

This technique can also be extended to provide support or engagement along other portions of the antenna. For example, a series of one or more metallic pads or strips 2220 can be deposited at spaced apart locations along the length of one or both sets of antenna radiators. As seen in FIG. 22E, the metallic pads or strips 2220 are positioned adjacent one or more radiators 104A-D but on the opposite side of support substrate 406 (100). These pads or strips are positioned so that when the antenna substrate is rolled or curved to produce the desired antenna, as seen in FIG. 22F, metallic pads or strips 2220 are positioned over a portion of radiators 104A–D on the opposite edge of the support substrate. Specifically, in one embodiment, metallic pads or strips 220 are positioned over a ground trace 1436 of radiators 104A–D. Metallized vias may be formed in pads 2220 where desired for the application or to improve transfer of heat to melt the solder.

If a small amount of solder 2226 is previously applied to a mating portion on the surface of ground trace 1436, it can be used to join these radiators to the strips. This provides additional joints or bonding points which efficiently hold the antenna structure together in the desired form. Where electrical connection is desired, metallized vias can be formed in the pads or strips which extend through to the opposite side. These pads can be used in conjunction with or without the strips previously discussed for the ground planes. Such a structure is especially useful where very long radiators, or multiple stacks of antenna radiators are contemplated which result in tall antenna structures.

Figure 23A:
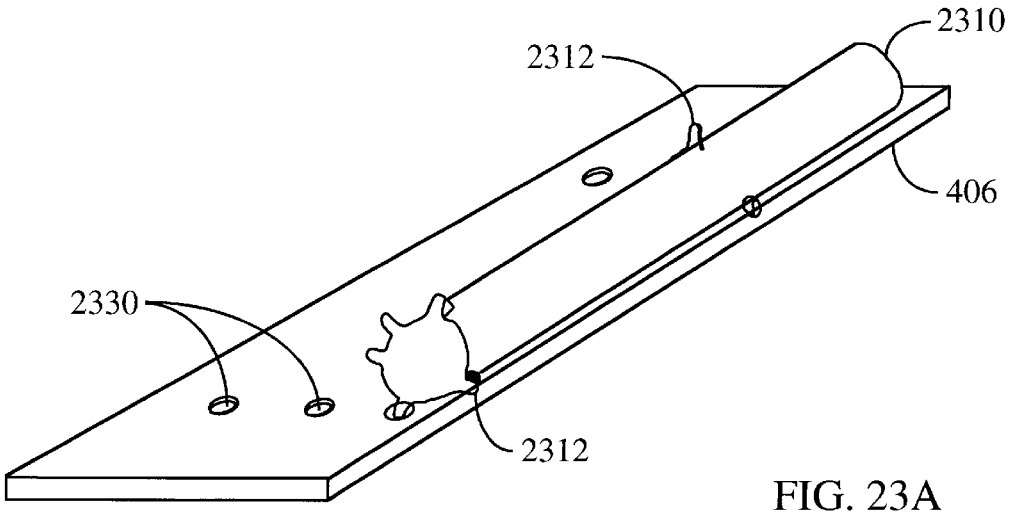
FIG. 23A is a diagram illustrating a form suitable for use in supporting an antenna in a cylindrical or other appropriate shape according to one embodiment.
Figure 23B:
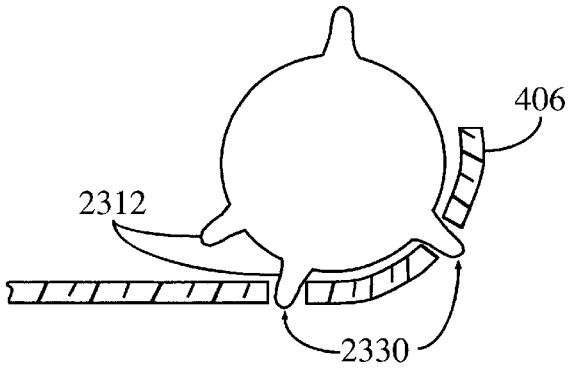
FIGS. 23B and 23C are diagrams illustrating the formation of an antenna in a cylindrical or other appropriate shape according to the embodiment illustrated in FIG. 23A.
Figure 23C:
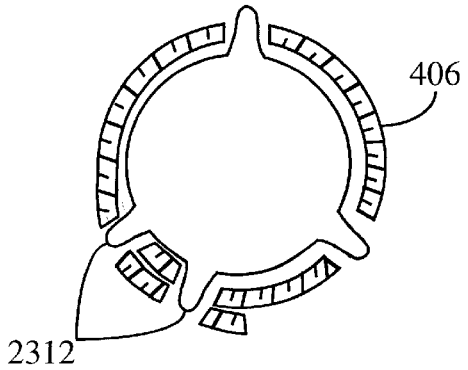

FIGS. 23A–23C illustrate a series of views of an example embodiment of a form 2310 used for rolling substrate 406 into the desired shape. The example illustrated in FIG. 23 is a form 2310 of cylindrical shape used in rolling the antenna and to provide continued support and rigidity for the antenna structure. In one embodiment, form 2310 can be provided with a series of prongs or teeth 2312 extending radially outward from an outer surface of form 2310. To interface with form 2310 and teeth 2312, a series of "tooling" or assembly "guide" holes or passages 2230 are provided in substrate 406 for mating with teeth 2312.

In FIG. 22A, tooling holes 2230 are illustrated as being positioned within ground planes 412. The metallic material of ground plane 412 acts to reinforce the holes and prevent deformation and movement when a relatively soft support substrate material is used. This assists with alignment accuracy for the antenna structure. However, there is no requirement for holes 2230 to be placed within a metallic layer.

Referring again to FIGS. 23A–23C, and commencing with the perspective view of FIG. 23A, substrate 406 is shown positioned to engage a support form 2310 by mating teeth 2312 with holes 2230. As seen in the side views of FIGS. 23B and 23C, as support form 2310 is rotated about its axis, or substrate 406 is otherwise wrapped around support form 2310, holes 2230 engage teeth 2312 which help position substrate 406 in place against or on support from 2310. Eventually, the entire substrate 406 is engaged against support form 2310. In FIG. 23C, substrate 406 is illustrated as having been wrapped around support form 2310 until it overlaps itself so that strips 2218, 2220 engage solder 2216, 2226 as described above.

Of course, where strips 2218, 2220 and solder 2216, 2226 are not used to join the substrate sections, substrate 406 does not need to overlap on support form 2310. Additionally, there is no requirement that support form 2310 extend the entire length of the antenna(s), radiators 104A–D or substrate 406. In some applications, some or all of the portions of the antenna may be self supporting, without the need for a form 2310. This feature can be advantageous, for example, to minimize the impact of the form 2310 on radiation patterns at certain frequencies.

For purposes of clarity and ease of illustration, in FIGS. 23A–23C, only substrate 406 is shown, without material layers for ground planes, radiators, feeds, feed networks, and so forth. It will also be readily apparent to those skilled in the relevant art how to size holes 2230 to match the dimensions of teeth 2312.

Form 2310, as illustrated in FIG. 23, can be constructed using a solid or hollow structure formed in a cylindrical or other desired shape, with teeth or prongs 2312 protruding therefrom. In this embodiment, form 2310 can be thought of, for example, as a variation of the toothed drum found in many music boxes. As would be apparent to one of ordinary skill in the art after reading this disclosure, alternative structures can be implemented to provide form 2310 including an axle/spoke arrangement, an axle/sprocket arrangement, or other appropriate configuration.

Note that it is contemplated that the spacing of the prongs 2312 or spokes may not be symmetrical about the support element. That is, the spacing may be larger in some portions in order to impart a greater amount of consistent tension in rolling, and smaller in some areas to better control substrate positioning where the substrate edges overlap. Preferably tooth spacing is chosen such that teeth 2312 apply a certain amount of tension to hold substrate 406 in place and to make the entire assembly a more rigid structure.

The use of holes 2230 and teeth 2312 provide improved manufacturing capabilities through position and assembly automation, and in precision placement or positioning of the substrate on a form that can be mounted within an antenna radome. This allows more precise structural definition and positioning of the antenna assembly, resulting in more precise control and compensation for the impact of the radome on radiation patterns.

The above description of the placement of metallic strips 2218, solder material 2216, and vias 2210 is provided by way of example. After reading this description, it would be apparent to a person skilled in the art how these components could be placed in alternative locations depending on the configuration desired. For example, these components can be positioned such that the antenna can be rolled to have right-hand or left-hand circular polarization and to have the radiators 104A–D on either the inside or the outside of the shape.

VIII. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

The previous description of the preferred embodiments is provided to enable any person skilled in the art to make or use the present invention. While the invention has been particularly shown and described with reference to preferred embodiments thereof, it will be understood by those skilled in the art that various changes in form and details may be made therein without departing from the spirit and scope of the invention.

What we claim as the invention is:

1. A dual band helical antenna, comprising:

a first antenna section comprising:

a first feed network disposed on a first side of a substrate on a first feed portion of the first antenna, a first ground plane disposed on a second side of said substrate and opposite said feed network, a first set of one or more radiators disposed on said substrate and extending from said feed network, and a tab extending from said first feed portion of said first antenna section positioned substantially along the axis of the antenna; and a second antenna section comprising:

a second feed network disposed on said substrate on a second feed portion, a second ground plane disposed on said substrate opposite said feed network, and a second set of one or more radiators disposed on said substrate and extending from said feed network.

2. The antenna according to claim 1, wherein said first ground plane electrically connects one end of said second set of one or more radiators.

3. The antenna according to claim 1, wherein said tab is positioned substantially along the axis of the antenna.

4. The antenna according to claim 1, wherein said tab extends from an end of said first feed portion that is closest to said second antenna.

5. The antenna according to claim 1, further comprising a connector connected to said tab.

6. The antenna according to claim 1, wherein said tab comprises means for providing a path for current to flow from said radiators of said second antenna section along the axis of said second antenna to thereby increase the energy radiated in the directions perpendicular to the axis.

7. The helical antenna of claim 1, wherein said first and second radiator segments are comprised of strip segments deposited on a dielectric substrate, wherein said dielectric substrate is shaped such that the radiators are wrapped in a helical fashion.

8. The helical antenna of claim 7, wherein said dielectric substrate is formed into a cylindrical, conical or other appropriate shape.

9. The antenna according to claim 1, wherein at least one of said first and second sets of one or more radiators comprise:

a first radiator segment extending in a helical fashion from a first end of the radiator portion toward the second end of the radiator portion; and a second radiator segment extending in a helical fashion from a second end of the radiator portion toward the first end of the radiator portion;

wherein said first radiator segment is in proximity with said second radiator segment such that said first and second radiator segments are electromagnetically coupled to one another.

10. The antenna of claim 9, wherein said first radiator segment is equal in length to said second radiator segment.

11. The antenna of claim 9, wherein said first and second radiator segments are $\lambda/4$ in length, where $\lambda$ is the wavelength of a resonant frequency of the antenna.

12. The antenna of claim 9, wherein said radiators further comprise one or more intermediate radiator segments positioned between said first and second radiator segments.

13. The antenna section of claim 1, wherein each antenna comprises four radiators and a feed network for providing a quadrature phase signal to said four radiators.

14. The antenna of claim 1, further comprising a feed point for each said radiator that is positioned at a distance from said first end along said first segment, wherein said distance is chosen to match the impedance of the radiators to a feed network.

15. The helical antenna section of claim 1, wherein said first antenna is stacked coaxially with said second antenna section.

16. A dual band helical antenna, comprising:

a first antenna section comprising:

a first feed network disposed on a first side of a substrate on a first feed portion of the first antenna, a first ground plane disposed on a second side of said substrate and opposite said feed network, and a first set of one or more radiators disposed on said substrate and extending from said feed network;

a second antenna section comprising:

a second feed network disposed on said substrate on a second feed portion, a second ground plane disposed on said substrate opposite said feed network;

a second set of one or more radiators disposed on said substrate and extending from said feed network; and a tab extending from said first feed portion of said first antenna section and running along the axis of said second antenna section for feeding said first antenna section for providing a path for current to flow from said radiators of said second antenna section along the axis of said second antenna section to thereby increase the energy radiated in the directions perpendicular to the axis.

17. The antenna according to claim 16, wherein said tab is positioned substantially along the axis of the antenna.

18. The antenna according to claim 16, wherein said tab extends from an end of said first feed portion that is closest to said second antenna section.

19. The antenna according to claim 16, wherein at least one of said first and second sets of one or more radiators comprise:

a first radiator segment extending in a helical fashion from a first end of the radiator portion toward the second end of the radiator portion; and a second radiator segment extending in a helical fashion from a second end of the radiator portion toward the first end of the radiator portion;

wherein said first radiator segment is in proximity with said second radiator segment such that said first and second radiator segments are electromagnetically coupled to one another.

20. The antenna of claim 19, wherein said first radiator segment is equal in length to said second radiator segment.

21. The antenna of claim 19, wherein said first and second radiator segments are $\lambda/4$ in length, where $\lambda$ is the wavelength of a resonant frequency of the antenna.

22. The antenna of claim 19, wherein said radiators further comprise one or more intermediate radiator segments positioned between said first and second radiator segments.

23. The antenna of claim 16, wherein each antenna section comprises four radiators and a feed network for providing a quadrature phase signal to said four radiators.

24. The antenna of claim 16, further comprising a feed point for each said radiator that is positioned at a distance from said first end along said first segment, wherein said distance is chosen to match the impedance of the radiators to a feed network.

25. A dual-band communication device having a dual band helical antenna, comprising:

a first antenna section comprising:

a first feed network disposed on a first side of a substrate on a first feed portion of the first antenna section, a first ground plane disposed on a second side of said substrate and opposite said feed network, and a first set of one or more radiators disposed on said substrate and extending from said feed network;

a second antenna section comprising:

a second feed network disposed on said substrate on a second feed portion, a second ground plane disposed on said substrate opposite said feed network;

a second set of one or more radiators disposed on said substrate and extending from said feed network; and a tab extending from said first feed portion of said first antenna section positioned substantially along the axis of the antenna for providing a path for current to flow from said radiators of said second antenna section along the axis of said second antenna section to thereby increase the energy radiated in the directions perpendicular to the axis.

* * * * *